US011835202B2

(12) United States Patent
Oshima et al.

(10) Patent No.: US 11,835,202 B2
(45) Date of Patent: Dec. 5, 2023

(54) ILLUMINATION DEVICE

(71) Applicant: Mitsubishi Electric Corporation, Tokyo (JP)

(72) Inventors: Ritsuya Oshima, Tokyo (JP); Masatoshi Nishimura, Tokyo (JP); Akihiro Yamada, Tokyo (JP); Muneharu Kuwata, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/773,046

(22) PCT Filed: Nov. 21, 2019

(86) PCT No.: PCT/JP2019/045523

§ 371 (c)(1),
(2) Date: Apr. 29, 2022

(87) PCT Pub. No.: WO2021/100161

PCT Pub. Date: May 27, 2021

(65) Prior Publication Data

US 2022/0397254 A1 Dec. 15, 2022

(51) Int. Cl.

| | |
|---|---|
| ***F21V 14/06*** | (2006.01) |
| ***F21V 5/04*** | (2006.01) |
| ***F21V 11/08*** | (2006.01) |
| ***F21Y 115/10*** | (2016.01) |

(52) U.S. Cl.

CPC ..... *F21V 14/06* (2013.01); *F21V 5/04* (2013.01); *F21V 11/08* (2013.01); *F21Y 2115/10* (2016.08)

(58) Field of Classification Search

CPC . F21V 14/06; F21V 5/04; F21V 5/008; F21V 11/08; F21V 14/04; F21Y 2115/10; F21S 41/635

See application file for complete search history.

(56) References Cited

U.S. PATENT DOCUMENTS

| | | | |
|---|---|---|---|
| 5,450,242 | A | 9/1995 | Kohmoto et al. |
| 2007/0133970 | A1 | 6/2007 | Honjo et al. |
| 2008/0074896 | A1 | 3/2008 | Ishida |

(Continued)

FOREIGN PATENT DOCUMENTS

| | | | | |
|---|---|---|---|---|
| EP | 3227601 | B1 * | 12/2021 | ..... F21K 9/62 |
| JP | 2-128111 | U | 10/1990 | |

(Continued)

OTHER PUBLICATIONS

International Search Report dated Feb. 10, 2020, Filed on Nov. 21, 2019, 9 pages including English Translation.

(Continued)

*Primary Examiner* — Erin Kryukova
(74) *Attorney, Agent, or Firm* — XSENSUS LLP

(57) ABSTRACT

An illumination device includes a light source unit that emits light, a first optical unit that lets the light enter and changes a divergence angle of the entered light, a second optical unit including an image light formation unit that lets the light with the changed divergence angle enter and emits light including image light having image information, and a drive unit that moves the first optical unit and the second optical unit.

19 Claims, 18 Drawing Sheets

(56) References Cited

U.S. PATENT DOCUMENTS

| | | | | |
|---|---|---|---|---|
| 2012/0287621 | A1* | 11/2012 | Lee | F21V 5/04 362/231 |
| 2016/0377256 | A1* | 12/2016 | Hansen | F21V 13/04 362/268 |
| 2017/0074497 | A1* | 3/2017 | Jurik | F21V 7/0091 |
| 2018/0118093 | A1* | 5/2018 | Yamazumi | B60Q 1/1423 |
| 2019/0360665 | A1* | 11/2019 | Latteo | G03B 21/14 |

FOREIGN PATENT DOCUMENTS

| | | | | | |
|---|---|---|---|---|---|
| JP | 7-41808 | U | | 7/1995 | |
| JP | 2004-136838 | A | | 5/2004 | |
| JP | 2004136838 | A | * | 5/2004 | |
| JP | 2006-58818 | A | | 3/2006 | |
| JP | 2008-84577 | A | | 4/2008 | |
| JP | 2008-91350 | A | | 4/2008 | |
| JP | 2011-22524 | A | | 2/2011 | |
| JP | 2013-182717 | A | | 9/2013 | |
| JP | 2015-41422 | A | | 3/2015 | |
| JP | 2016-18112 | A | | 2/2016 | |
| WO | WO-2013009197 | A1 | * | 1/2013 | F21K 9/65 |
| WO | WO-2015197654 | A1 | * | 12/2015 | F21V 14/06 |
| WO | 2016/051863 | A1 | | 4/2016 | |

OTHER PUBLICATIONS

Japanese Office Action dated Aug. 30, 2022, in Japanese Patent Application No. 2021-558108, 6 pp.

* cited by examiner

ILLUMINATION DEVICE

CROSS-REFERENCE TO RELATED APPLICATION

The present application is based on PCT filing PCT/JP2019/045523, filed Nov. 21, 2019, the entire contents of which are incorporated herein by reference.

TECHNICAL FIELD

The present invention relates to an illumination device.

BACKGROUND ART

There has been proposed a light fixture for a vehicle as an illumination device capable of switching the emitted illuminating light to light in a light distribution pattern of a low beam or light in a light distribution pattern of a high beam by simultaneously executing an operation of switching the position of a movable lens between two positions and an operation of switching the position of a movable shade between two positions by using one actuator (see Patent Reference 1, for example). Here, the movable shade is a light blocking member that blocks a part of light emitted from a light source unit.

PRIOR ART REFERENCE

Patent Reference

Patent Reference 1: Japanese Patent Application Publication No. 2015-041422 (see FIG. 1 and FIG. 8, for example)

SUMMARY OF THE INVENTION

Problem to be Solved by the Invention

However, in the above-described conventional device, the light distribution patterns of the illuminating light that can be implemented are only two types since the switching of the position of the movable lens and the switching of the position of the movable shade are made at the same time. Namely, the above-described conventional device is only capable of making the switching between two types of light distribution patterns as an illumination device and is incapable of having two different functions: an illumination function and a projection function, to be switchable and with high functionality, such as being capable of switching between the illumination function of emitting the illuminating light in order to brighten a space and the image projection function of projecting image light having image information onto a projection surface, further changing the direction of the image information in the image projection function after the switching, and further changing the light distribution pattern of the illuminating light in the illumination function after the switching.

An object of the present invention, which has been made to resolve the above-described problem with the conventional technology, is to provide an illumination device realizing further increased functionality, such as an illumination device having the two different functions: not only the illumination function but also the projection function, to be switchable and with high functionality.

Means for Solving the Problem

An illumination device according to an aspect of the present invention includes a light source unit to emit light; a first optical unit to let the light enter and to change a divergence angle of the entered light; a second optical unit including an image light formation region, the second optical unit letting the light with the changed divergence angle enter and emitting light including image light having image information; and a drive unit to move the first optical unit and the second optical unit, wherein the drive unit executes, as said moving, a first operation of translating the first optical unit in a direction of an optical axis of the first optical unit.

Effect of the Invention

According to the present invention, further increased functionality of an illumination device can be realized.

MODE FOR CARRYING OUT THE INVENTION

Figure 1:
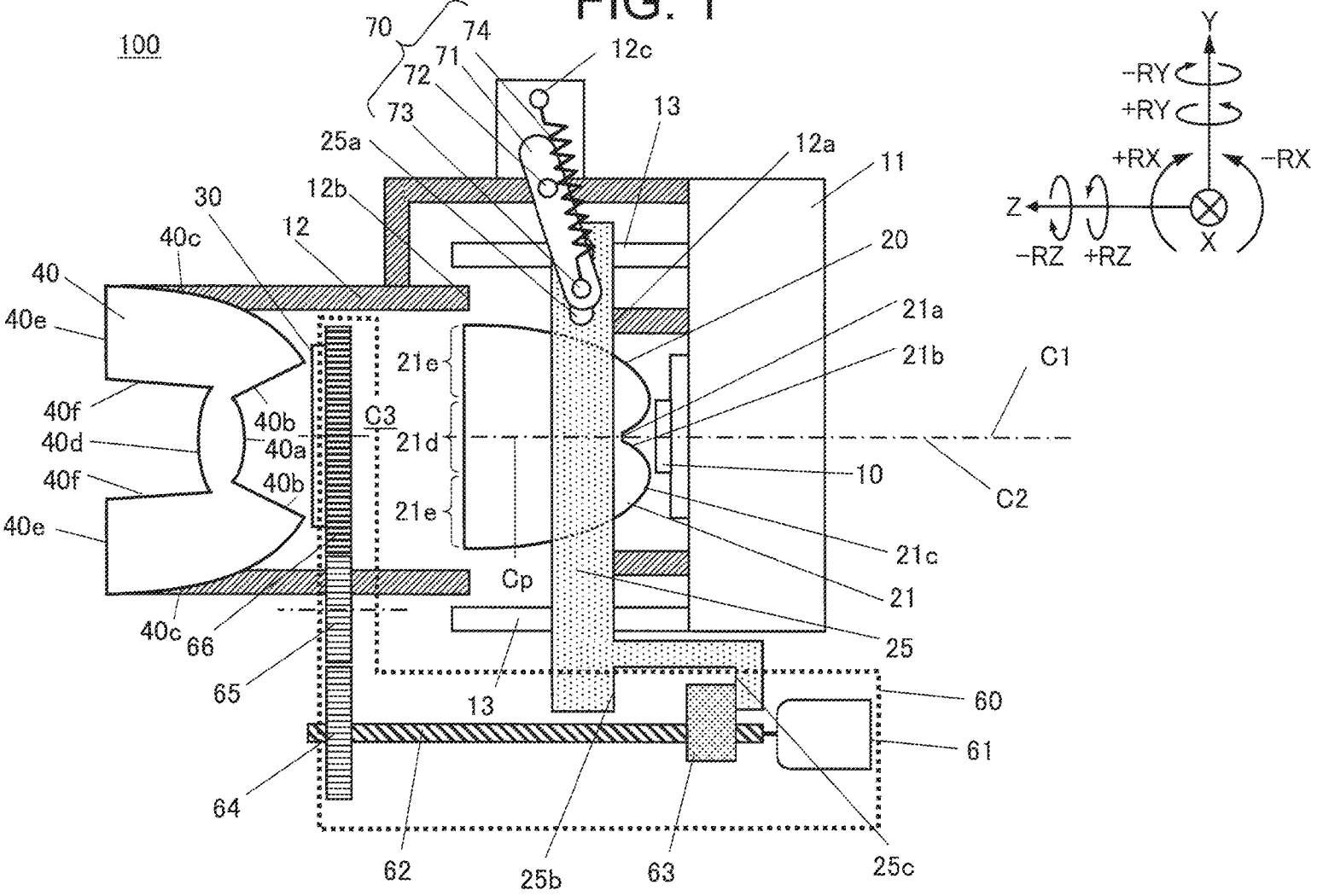
FIG. 1 is a side view schematically showing internal structure of an illumination device according to a first embodiment of the present invention.

Illumination devices according to embodiments of the present invention will be described below with reference to the drawings. The illumination devices according to the embodiments are illumination devices having a function of projecting an image onto an illuminated surface (more specifically, applying image light having image information to the illuminated surface and thereby making an observer recognize an image represented by the image information). The illumination device according to each embodiment is referred to also as an "illumination device with the projection function" or a "projection device with the illumination function", or simply as a "projection device". The following embodiments are just examples and a variety of modifications are possible within the scope of the present invention. Incidentally, throughout the drawings, the same or similar components are assigned the same reference character.

The illumination device according to each embodiment is a spotlight, a downlight, a ceiling light or the like, for example. The illumination device has an image projection function of applying image light, as light having image information regarding any intended figure including a symbol such as an arrow mark, a picture, a photograph, characters or the like (hereinafter referred to collectively as an "image"), to an illuminated surface and a function as an ordinary illuminator (illumination function of emitting illuminating light in order to increase the brightness of the surroundings). In the embodiments, the illuminating light emitted at the time of the image projection function is light forming an image on the illuminated surface (light including at least image light), whereas the illuminating light emitted at the time of the illumination function is light not forming an image on the illuminated surface, that is, light not having image information. In the following description, a simple term "illuminating light" collectively means light emitted from the illumination device irrespective of which function the light corresponds to.

In the drawings, coordinate axes of an XYZ orthogonal coordinate system and rotation directions around each coordinate axis are shown in order to facilitate the understanding of the invention. In first and second embodiments, a +Z-axis direction is an emission direction of the illuminating light emitted from the illumination device. For example, when the illumination device is a downlight illuminator that illuminates a predetermined illuminated surface such as a floor surface, the +Z-axis direction is a direction heading towards the floor surface as viewed from the illumination device, and a −Z-axis direction is a direction opposite to the +Z-axis direction. Incidentally, the +Z-axis direction may be defined as a direction pointing in a traveling direction of the light emitted from a light source unit 10 as one of the directions of an optical axis C1 of the light source unit 10 which will be described later, and the −Z-axis direction may be defined as the direction opposite to the +Z-axis direction. Further, the illumination device is not limited to a downlight illuminator.

In a third embodiment, a −Y-axis direction is the emission direction of the illuminating light emitted from the illumination device.

A +RZ direction is a clockwise direction as viewed in the +Z-axis direction, and a −RZ direction is a counterclockwise direction as a direction opposite to the +RZ direction. A +RX direction is a clockwise direction as viewed in the +X-axis direction, and a −RX direction is a counterclockwise direction as a direction opposite to the +RX direction. A +RY direction is a clockwise direction as viewed in the +Y-axis direction, and a −RY direction is a counterclockwise direction as a direction opposite to the +RY direction.

(1) FIRST EMBODIMENT

(1-1) Configuration of First Embodiment

<Illumination Device 100>

FIG. 1 is a side view schematically showing internal structure of an illumination device 100 according to the first embodiment. As shown in FIG. 1, the illumination device 100 includes the light source unit 10, a first optical unit 20, a second optical unit 30 and a drive unit 60. Further, the illumination device 100 may include a third optical unit 40.

The light source unit 10 emits light. In the following description, the light emitted by the light source unit 10 can be represented as light L1 (see the light L1 shown in FIG. 6 and FIG. 12 which will be explained later, for example).

The first optical unit 20 lets the light (L1) emitted from the light source unit 10 enter and changes light distribution of the entered light. The first optical unit 20 can be a unit that changes a divergence angle of the entered light. The light distribution is luminosity distribution of light with respect to space. Namely, the light distribution is spatial distribution of the light emerging from a light source. The divergence angle means a spreading angle of light. Incidentally, the divergence angle can also mean an angle of light being condensed. The divergence angle is referred to also as a condensation angle or a spread angle. In the following description, the light emitted from the first optical unit 20 can be represented as light L2 (see the light L2 shown in FIG. 6 and FIG. 12 which will be explained later, for example). The light L2 includes at least one of a converging light component and a diverging light component. Further, the first optical unit 20 can be a light deflection unit that changes the traveling direction of light by either refraction or reflection of light.

The first optical unit 20 can be a light distribution variable lens 21 as a light distribution variable member, for example. Further, the illumination device 100 may include a support member (first support member) 25 that supports the first optical unit 20. For example, the support member 25 supports the first optical unit 20 so that the first optical unit 20 can translate along an optical axis Cp of the optical system (more specifically, an optical axis C2 of the first optical unit 20). In the illustrated example, the Z-axis direction coincides with the optical axis Cp and the optical axis C2, and the support member 25 supports the first optical unit 20 to be linearly movable in the +Z-axis direction and the −Z-axis direction. The support member 25 may be integrated with a base member (not shown) on which an optical element (e.g., light distribution variable lens) constituting the first optical unit 20 is formed.

Here, the optical axis Cp is the optical axis of an illumination optical system including at least the light source unit 10, the first optical unit 20 and the second optical unit 30, coincides with the optical axis C1 in a certain region (more specifically, until the light from the light source unit 10 is incident upon another optical member), and is changed according to an optical central axis of the subsequent light beam in cases where the light emitted from the light source unit 10 thereafter undergoes deflection, splitting, light distribution control or the like. Incidentally, when a toric light beam in which the intensity at the center is zero or extremely low compared to the intensity at the periphery is formed by the light distribution control or the like, the center of the toric light beam is regarded as the optical central axis, and the optical axis Cp in many cases coincides with the optical axis of the optical element forming the light beam.

Incidentally, it is also possible for the support member 25 to support the first optical unit 20 so that the first optical unit 20 can translate along an axis other than the optical axis Cp, for example. It is permissible if the support member 25 is capable of supporting the first optical unit 20 to be movable in a first direction for increasing the distance from the light source unit to the first optical unit and a second direction for decreasing the distance from the light source unit 10 to the first optical unit 20, wherein the movement is not limited to translation.

The illumination device 100 is capable of changing the distance between the light source unit 10 and the first optical unit 20 by the movement of the first optical unit 20 and thereby changing the light distribution pattern of the illuminating light emitted from the illumination device 100. In this case, the illumination device 100 changes a range of the light incident upon the first optical unit 20 (a region on the first optical unit 20) by the movement of the first optical unit 20 in the optical axis Cp direction.

Here, the first direction (the +Z-axis direction in this example) is the direction for increasing the distance from the light source unit 10 to the first optical unit 20, and the second direction (the −Z-axis direction in this example) is the direction for decreasing the distance. The first optical unit 20 may be formed with a combination of a plurality of lens elements. Further, in the case where the first optical unit 20 is a light distribution variable member, the first optical unit 20 may be formed with a reflecting mirror instead of the light distribution variable lens. In the following description, the light emitted from the first optical unit 20 can be represented as the light L2 (see the light L2 shown in FIG. 6 and FIG. 12 which will be explained later, for example).

The second optical unit 30 is an optical element including at least an image light formation region 31 that lets the light (L2) emitted from the first optical unit 20 enter and emits image light having image information. In the following description, the light emitted from the second optical unit 30 can be represented as light L3, in which the image light formed by the image light formation region 31 can be represented as light L31, and light that passed through a region (light transmissive region 32 which will be described later) around the image light formation region 31 can be represented as light L32. Further, the illumination device 100 may include a support member (second support member) 66 that supports the second optical unit 30. For example, the support member 66 supports the second optical unit 30 to be rotatable around an optical axis Cp of the optical system (more specifically, an optical axis C3 of the second optical unit 30) as a rotation center axis. In the illustrated example, the Z-axis direction coincides with the optical axis Cp and the optical axis C3, and the support member 66 supports the second optical unit 30 to be rotatable in the +RZ-axis direction and the −RZ-axis direction. The support member 66 may be integrated with a base member (not shown) on which an optical element constituting the second optical unit 30 is formed.

Here, a third direction (the +RZ-axis direction in this example) and a fourth direction (the −RZ-axis direction in this example) are directions for rotating around an axis parallel to the optical axis Cp as the rotation center. Incidentally, while a case where the second optical unit 30 is supported to be rotatable around the optical axis C3 has been described above, the second optical unit 30 may be supported to be movable in a direction crossing the optical axis C3 or a direction parallel to the optical axis C3. For example, the second optical unit 30 may be supported to be movable in one or more directions among a rotation direction around the optical axis C3, a direction crossing the optical axis C3 and a direction parallel to the optical axis C3.

The third optical unit 40 forms illuminating light having a predetermined light distribution pattern from the light L3 emitted from the second optical unit 30 and emits the illuminating light. The third optical unit 40 is a projection lens, for example. The third optical unit 40 may be formed with a combination of a plurality of lens elements. The third optical unit 40 may be formed with a reflecting mirror or a combination of a reflecting mirror and a lens.

Figure 6:
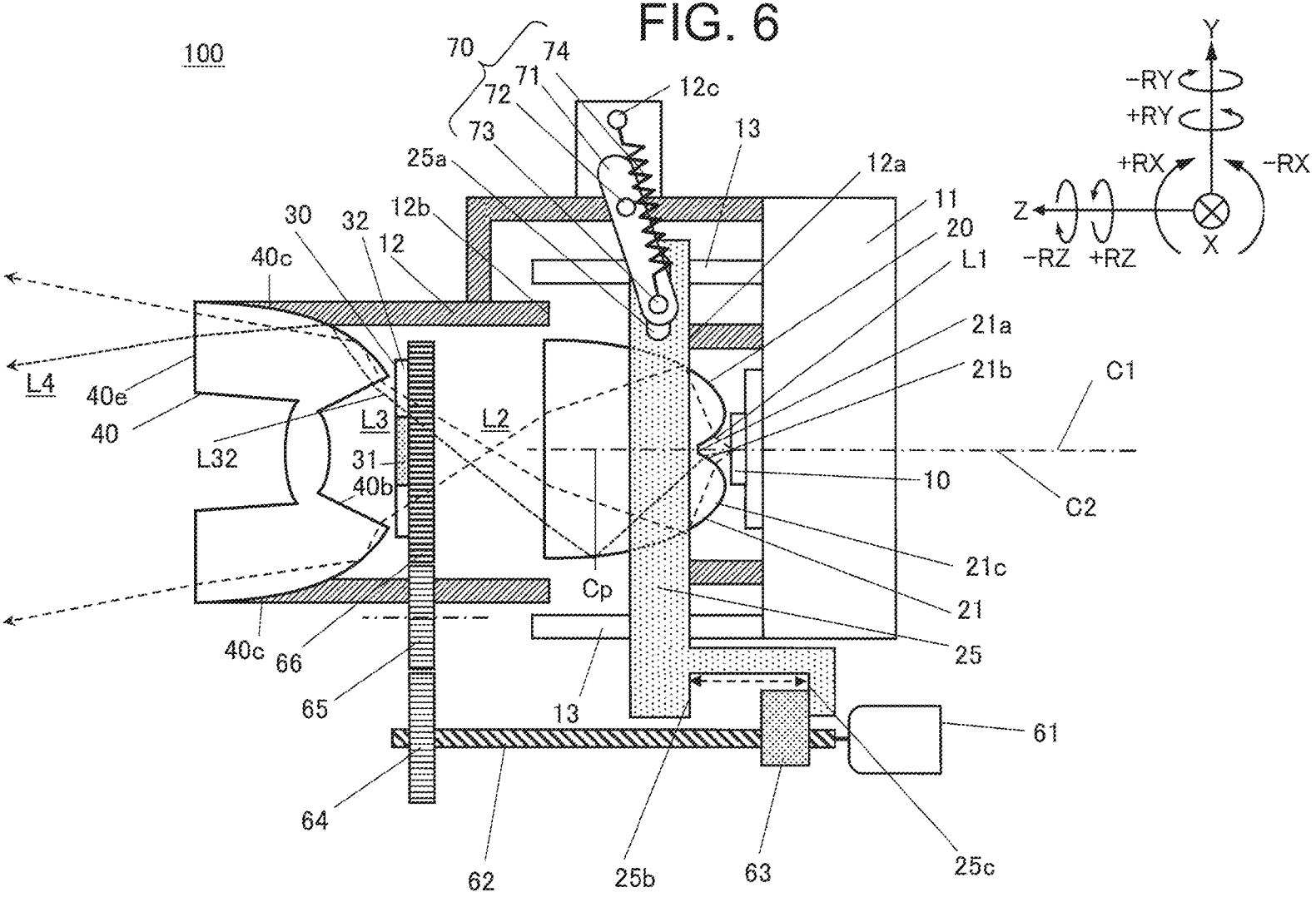
FIG. 6 is a diagram showing principal rays of light when the first optical unit is at a first position in the illumination device according to the first embodiment.
Figure 10:
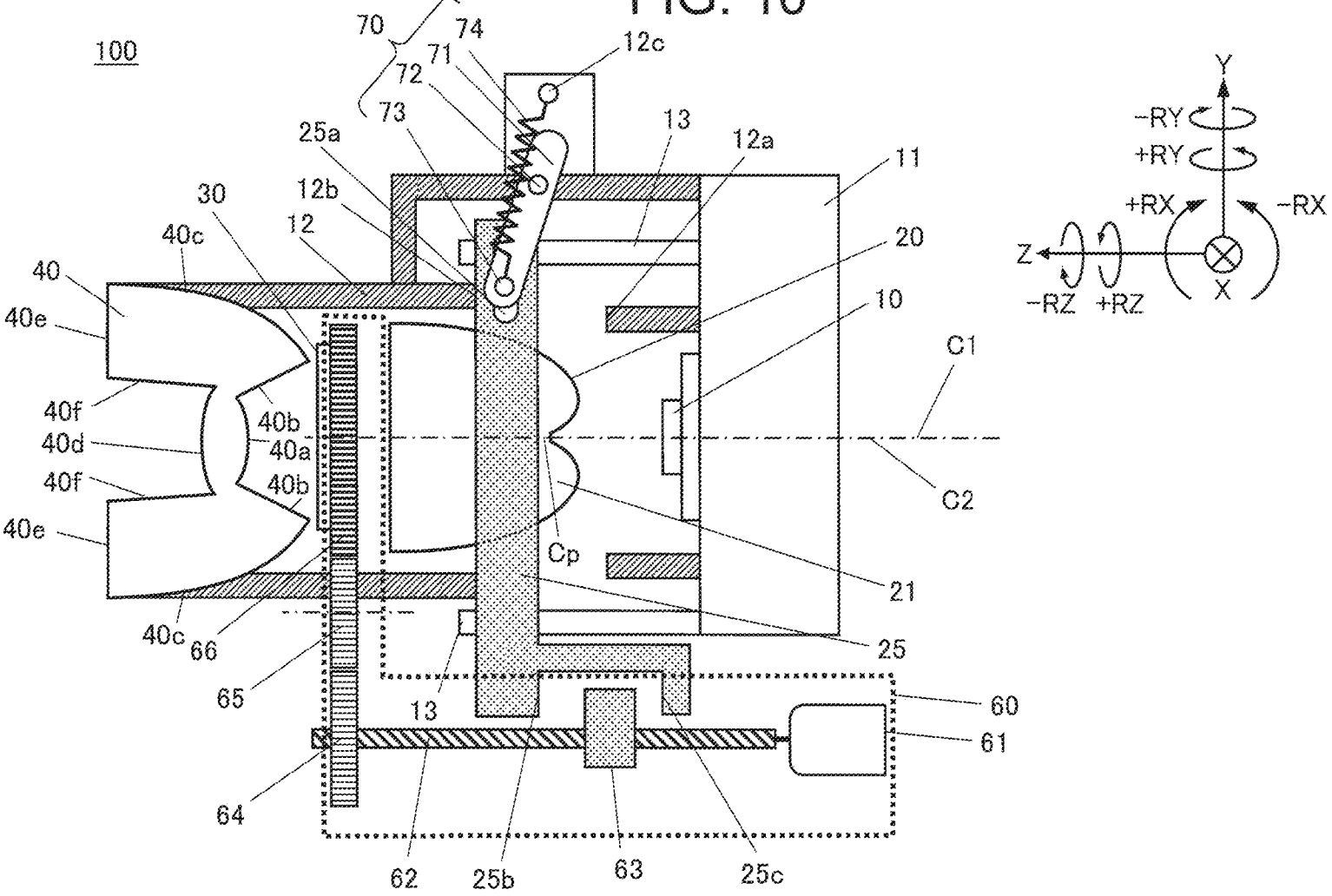
FIG. 10 is a side view showing a state in which the first optical unit has been moved by a toggle mechanism from the first reference position to a second position in the illumination device according to the first embodiment.
Figure 12:
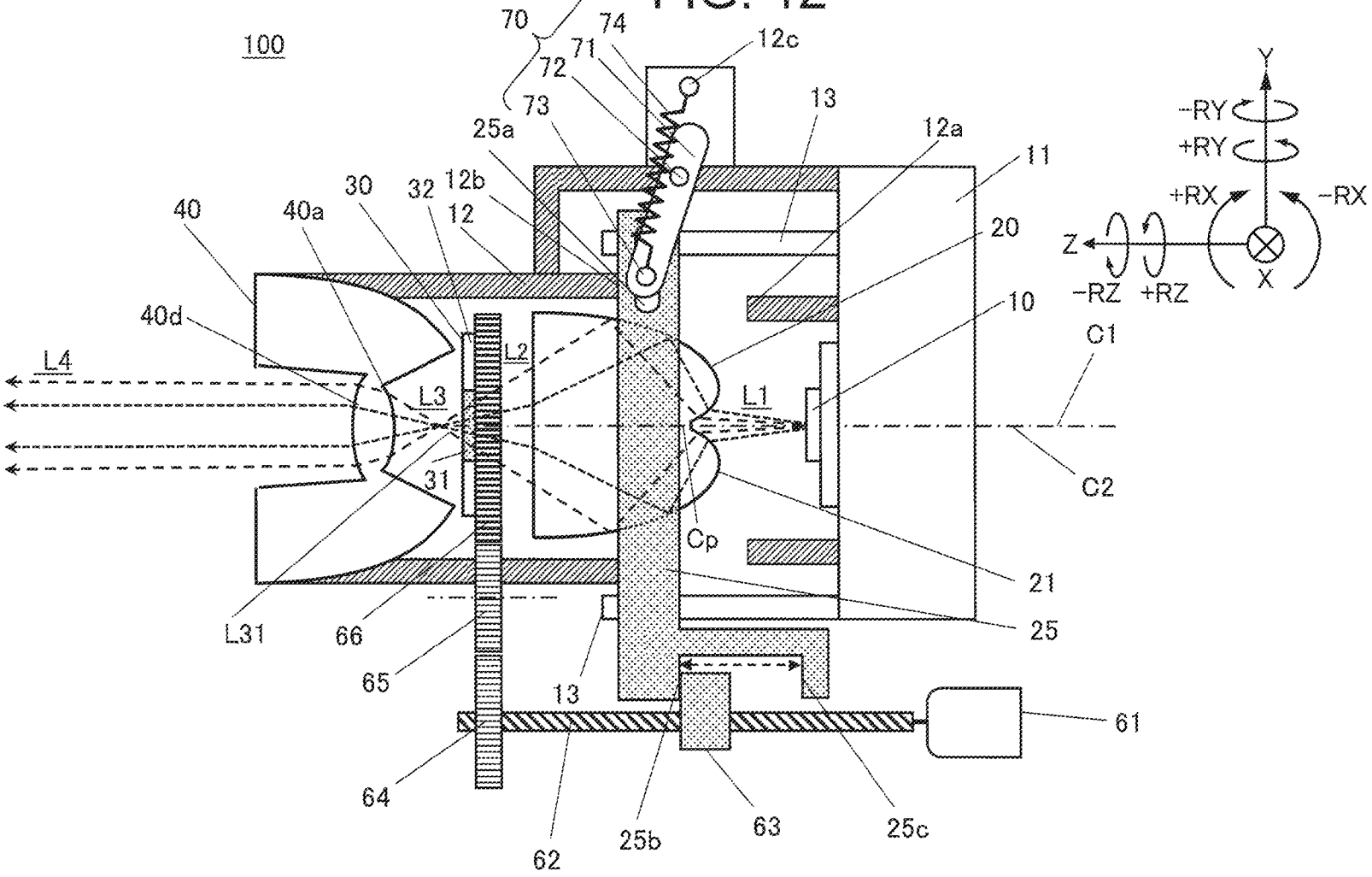
FIG. 12 is a diagram showing principal rays of light when the first optical unit is at the second position in the illumination device according to the first embodiment.

Further, the illumination device 100 includes the drive unit 60 that moves the first optical unit 20 and the second optical unit 30. In this embodiment, the drive unit 60 has a function of executing a first operation of translating the first optical unit 20 in a predetermined direction and a second operation of rotating the second optical unit 30 without moving the first optical unit 20. More specifically, the drive unit 60 may include a mechanism that executes a first operation of moving the first optical unit 20 between a first position as a predetermined position close to the light source unit 10 (i.e., a position as one movement end where the support member 25 makes contact with a hit surface 12*a* as shown in FIG. 1 and FIG. 6 which will be explained later) and a second position as a predetermined position farther from the light source unit 10 than the first position (i.e., a position as the other movement end where the support member 25 makes contact with a hit surface 12*b* as shown in FIG. 10 and FIG. 12 which will be explained later) and a second operation of moving the second optical unit 30 in the +RZ direction and the −RZ direction without moving the first optical unit 20. The drive unit 60 switches between the projection function as the function as the projection device and the illumination function as the function as the illumination device by the first operation. Further, the drive unit 60 changes the direction of the image information included in the image light projected at the time of the projection function by the second operation.

In the case where the illumination device 100 is a downlight, the illumination device 100 may operate as a simple illumination device that emits illuminating light not including image light towards a wide range on the floor surface when the first optical unit 20 is at the first position, and operate as a projection device that projects illuminating light including image light (e.g., light that forms an image such as an arrow mark on the illuminated surface) onto a narrow range on the floor surface when the first optical unit 20 is at the second position, for example. Further, the illumination device 100 may be capable of changing the direction of the image information indicated by the image light by rotating the second optical unit 30 when the first optical unit 20 is at the second position. Furthermore, the illumination device 100 may be capable of adjusting (e.g., widening or narrowing) the emission range of the illuminating light not including image light by moving (adjusting) the position of the first optical unit 20 between the first position and the second position.

Further, the illumination device 100 includes a holding part 12 and a toggle mechanism 70. The holding part 12 is, for example, a part of a housing of the illumination device 100.

For example, the holding part 12 fixes or movably holds optical units included in the illumination device 100 or a support part that supports the optical units. Incidentally, in this example, the holding part 12 is fixed to a base member 11. For example, the holding part 12 holds the support member 25 supporting the first optical unit 20 so that the support member 25 can translate in the first direction and the second direction opposite to the first direction. Further, the holding part 12 holds a gear 66, as a support part supporting the second optical unit 30, to be rotatable in the third direction and the fourth direction opposite to the third direction. Furthermore, the holding part 12 fixes and holds the third optical unit 40. For example, the holding part 12 holds these optical elements so that the optical axes of the light source unit 10, the first optical unit 20, the second optical unit 30 and the third optical unit 40 coincide with each other.

Figure 9:
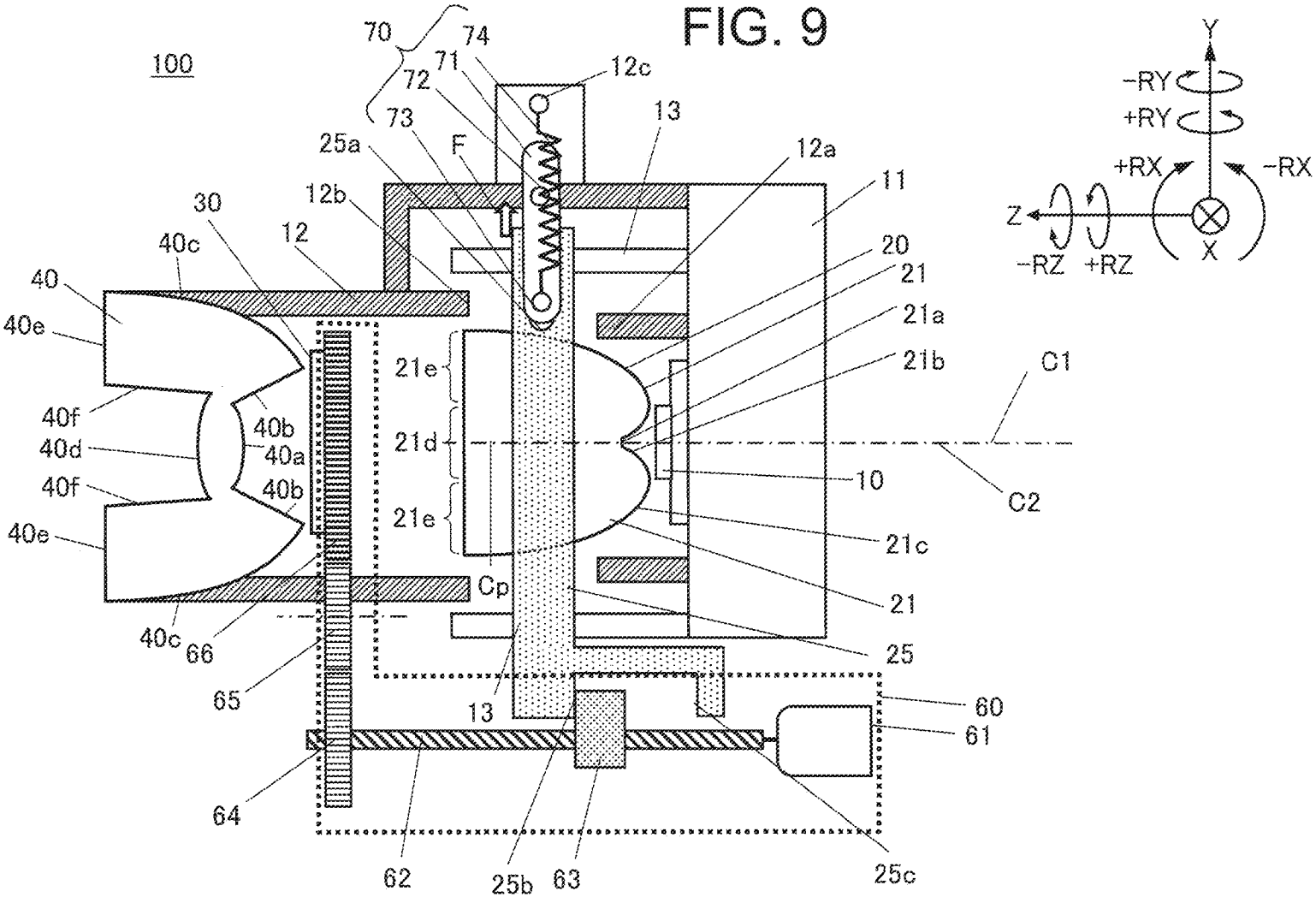
FIG. 9 is a side view showing a state in which the first optical unit moved in the +Z-axis direction by the drive unit has reached a first reference position in the illumination device according to the first embodiment.

As shown in FIG. 9 which will be explained later, the toggle mechanism 70 applies force for moving the first optical unit 20 in the +Z-axis direction to the support member 25 when the first optical unit 20 moving in the +Z-axis direction crosses a predetermined first reference position to a +Z-axis direction side (traveling direction side). Here, the first reference position is a position where a fixation part 12*c*, a pin 73 and a spindle 72 are linearly aligned.

Figure 15:
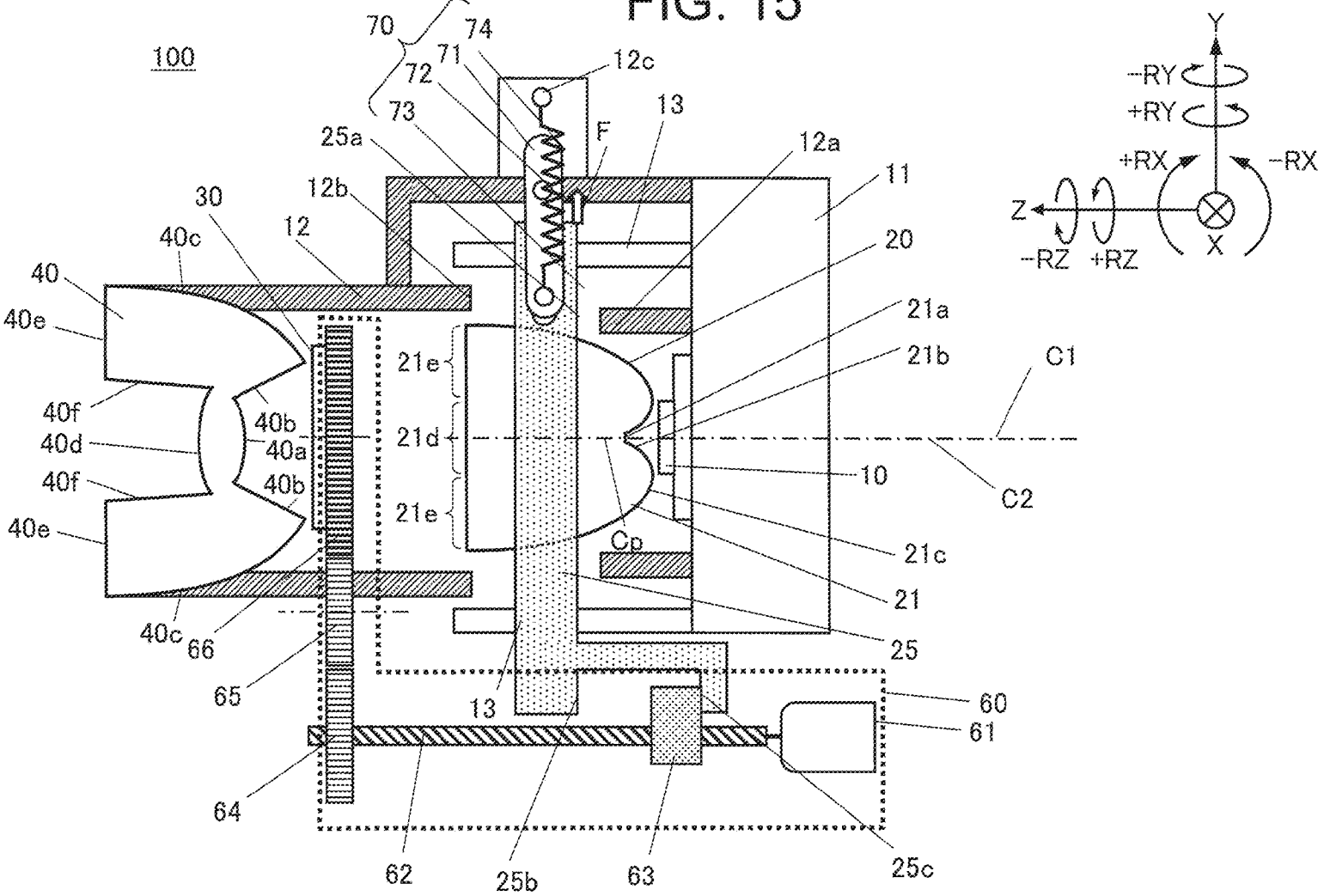
FIG. 15 is a side view showing a state in which the first optical unit moved in the −Z-axis direction by the drive unit has reached a second reference position in the illumination device according to the first embodiment.

Further, as shown in FIG. 15 which will be explained later, the toggle mechanism 70 applies force for moving the first optical unit 20 in the −Z-axis direction to the support member 25 when the first optical unit 20 moving in the −Z-axis direction crosses a predetermined second reference position to a −Z-axis direction (traveling direction) side. Here, the second reference position is a position where the fixation part 12*c*, the pin 73 and the spindle 72 are linearly aligned.

The illumination device 100 can also be configured to include no toggle mechanism 70. With the toggle mechanism 70, the switching of the first optical unit 20 between the first position and the second position in the illumination device 100 can be made quickly.

<Light Source Unit 10>

The light source unit 10 emits the light L1 as first light. From the viewpoint of lightening the load on the environment such as reduction in carbon dioxide ($CO_2$) emission and reduction in fuel consumption, the light source unit 10 is desired to be a semiconductor light source having high luminous efficiency. The semiconductor light source is a light-emitting diode (LED), a laser diode (LD) or the like, for example. The light source unit 10 can also be a lamp light source including a halogen bulb or the like. Further, the light source unit 10 can also be a solid-state light source. Examples of the solid-state light source include an organic electroluminescence (organic EL) light source, a light source that makes a fluorescent substance emit light by irradiating the fluorescent substance with pumping light, and so forth. The semiconductor light source is a type of the solid-state light source.

The light source unit 10 is held on the base member 11. The base member 11 includes a heat radiator. The following description will be given of a case where the light source unit 10 is an LED. The optical axis C1 is the optical axis of the light source unit 10. For example, the optical axis C1 of the light source unit 10 is an axis passing through the center of a light emission surface of the light source unit 10 and being orthogonal to the light emission surface. The optical axis C1 of the light source unit 10 is referred to also as a main optical axis. The main optical axis is an optical central axis of the light emitted by the light source unit 10 and generally coincides with an emission direction of light at the maximum luminosity included in the light emitted from the light source unit 10. Further, the optical axis C1 is also an optical axis constituting a part of the optical axis Cp of the illumination optical system in the illumination device 100.

<First Optical Unit 20>

The first optical unit 20 is the light distribution variable lens 21 as the light distribution variable member, for example. Further, in the first embodiment, the first optical unit 20 is supported by the support member 25. The support member 25 may be configured as a part of the drive unit 60, for example. Incidentally, the first optical unit 20 may include the light distribution variable lens 21 as the light distribution variable member and the support member 25. The light distribution variable lens 21 shapes the light L1 emitted from the light source unit 10. The light distribution variable lens 21 is a condensing lens, for example. When the light source unit 10 includes an LED light source having a large divergence angle, the light can be condensed efficiently by using the light distribution variable lens 21. The light distribution variable lens 21 emits the entered light in the direction of the optical axis Cp (the optical axis C2 in this example) that is the traveling direction of the light from the light source unit 10 (the +Z-axis direction in this example).

Figure 2:
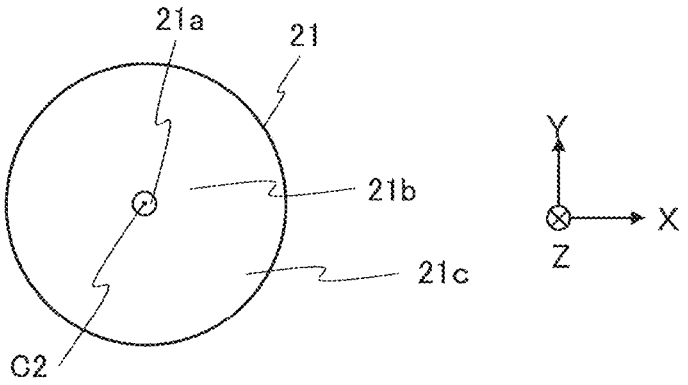
FIG. 2 is a diagram schematically showing a light distribution variable lens as a first optical unit of the illumination device according to the first embodiment.

FIG. 2 is a diagram schematically showing the light distribution variable lens 21. FIG. 2 shows the shape of the light distribution variable lens 21 as viewed in the +Z-axis direction. The light distribution variable lens 21 has optical surfaces 21*a*, 21*b*, 21*c*, 21*d* and 21*e*, for example. The optical surfaces 21*a* and 21*b* are light incidence surfaces. The light L1 emitted from the light source unit 10 is incident upon the optical surfaces 21*a* and 21*b*. The optical surface 21*c* is a light-reflecting surface. The light that entered the light distribution variable lens 21 is reflected by the optical surface 21*c*. The optical surfaces 21*d* and 21*e* are light emission surfaces. The light that entered the light distribution variable lens 21 is emitted from the optical surfaces 21*d* and 21*e*. The structure of the light distribution variable lens 21 is not limited to that shown in FIG. 1 and FIG. 2.

The support member 25 supporting the first optical unit 20 (the light distribution variable lens 21 in this example) is supported to be movable with respect to the base member 11 along a slide guide 13 provided on the base member 11. The support member 25 moves in the direction of the optical axis Cp (the Z-axis direction in this example) along the slide guide 13. According to the movement of the support member 25, the first optical unit 20 also moves in the direction of the optical axis Cp. The range in which the first optical unit 20 can move in the direction of the optical axis Cp is restricted by the hit surfaces 12*a* and 12*b* provided on the holding part 12. In this example, the hit surface 12*a* is a surface supported by the base member 11, placed on the −Z-axis side of the support member 25, and facing the +Z-axis direction. The hit surface 12*b* is a surface supported by the base member 11, placed on the +Z-axis side of the support member 25, and facing the −Z-axis direction. When an end part of the support member 25 in the −Z-axis direction hits the hit surface 12*a* of the holding part 12, the support member 25 cannot move in the −Z-axis direction any more. Further, when an end part of the support member 25 in the +Z-axis direction hits the hit surface 12*b* of the holding part 12, the support member 25 cannot move in the +Z-axis direction any more.

The support member 25 has a groove 25*a* extending in the Y-axis direction (a direction orthogonal to the moving direction of the first optical unit 20), for example. The pin 73 provided on an arm 71 is inserted in the groove 25*a*. The pin 73 is movable in a lengthwise direction of the groove 25*a*, that is, the Y-axis direction. The arm 71 is provided on the holding part 12. The arm 71 is provided to be rotatable in the +RX direction and the −RX direction around the spindle 72 as a rotation center shaft.

Both ends of an elastic member 74 are respectively connected to the pin 73 provided on the arm 71 and the fixation part 12*c* as a fixation point provided on the holding part 12. The fixation part 12*c* is a fixing pin, for example. The fixation part 12*c* is situated in the +Y-axis direction from the spindle 72. The elastic member 74 is a tension spring that applies tensile force between the pin 73 and the fixation part 12*c*. The arm 71, the spindle 72, the pin 73 and the elastic member 74 constitute the toggle mechanism 70.

When the support member 25 supporting the light distribution variable lens 21 is at the first position, the spindle 72 is situated on the +Z-axis direction side of a straight line connecting the fixation part 12*c* and the pin 73. At that time, torque in the −RX direction occurs to the arm 71 due to the tensile force of the elastic member 74. Due to the engagement of the pin 73 and the groove 25*a*, this torque causes pressing force that presses the support member 25 against the hit surface 12*a*. By this pressing force, the support member 25 is stably held at the first position.

In contrast, when the support member 25 is at the second position, the spindle 72 is situated on the −Z-axis direction side of the straight line connecting the fixation part 12*c* and the pin 73. At that time, torque in the +RX direction occurs to the arm 71 due to the tensile force of the elastic member 74. Due to the engagement of the pin 73 and the groove 25*a*, this torque causes pressing force that presses the support member 25 against the hit surface 12*b*. By this pressing force, the support member 25 is stably held at the second position.

Further, the support member 25 has a hit surface 25*b* and a hit surface 25*c* that make contact with a slide nut 63 of the drive unit 60 which will be described later. The hit surface 25*b* and the hit surface 25*c* are arranged with spacing in a direction parallel to the optical axis Cp.

The optical axis C2 is the optical axis of the first optical unit 20 (the light distribution variable lens 21 in this example). Further, the optical axis C2 is also an optical axis constituting a part of the optical axis Cp of the illumination optical system in the illumination device 100. The optical axis Cp and the optical axis C2 coincide with each other at least while the light from the light source unit 10 is emitted from the first optical unit 20 and is incident upon a different optical member. The optical axis C2 of the first optical unit 20 and the optical axis of the different optical member may be either the same axis or different axes. For example, the optical axis C1 and the optical axis C2 can be set in directions different from each other by using a mirror or the like.

<Second Optical Unit 30>

Figure 3:
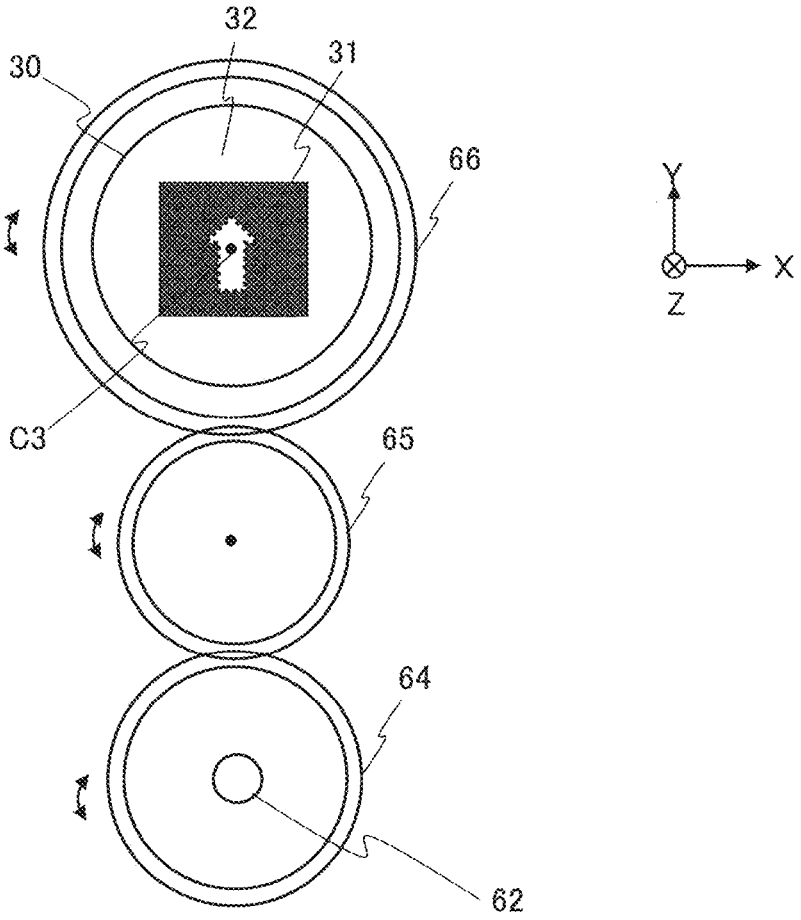
FIG. 3 is a diagram schematically showing an image light formation unit as a second optical unit and a gear in the illumination device according to the first embodiment.

FIG. 3 is a diagram schematically showing the second optical unit 30 and a gear set including the gear 66 as a support member rotatably supporting the second optical unit 30. The second optical unit 30 can be an optical element (that can hereinafter be referred to as an image light formation unit) including the image light formation region 31 for forming the image light. When the light L2 emitted from the light distribution variable lens 21 enters the image light formation region 31, the image light formation region 31 forms the image light (L31) having the image information from the entered light L2. For example, the second optical unit 30 can be an optical element including the image light formation region 31 arranged in a central region and the light transmissive region 32 arranged in a peripheral region as a region around the central region.

The light L2 passing through the image light formation region 31 is transformed into image light L3. Incidentally, the light transmissive region 32 can be any region as long as the region is capable of allowing light to pass through, such as an air layer, for example. The light L3 can include the image light (L31) that passed through the image light formation region 31 and the light (L32) that passed through the light transmissive region 32. Incidentally, the light L3 can be light including only the image light (L31) that passed through the image light formation region 31, light including only the light (L32) that passed through the light transmissive region 32, or light including both of the image light (L31) that passed through the image light formation region 31 and the light (L32) that passed through the light transmissive region 32.

The second optical unit 30 is supported by the gear 66 to be rotatable in the +RZ direction and the −RZ direction around the optical axis Cp (more specifically, the optical axis C3 of the second optical unit 30), for example. Incidentally, it is permissible even if the second optical unit 30 is supported to be rotatable around an axis different from the optical axis Cp (e.g., an axis parallel to the optical axis Cp) as a rotation center axis.

The optical axis C3 is the optical axis of the second optical unit 30. Further, the optical axis C3 is also an optical axis constituting a part of the optical axis Cp of the illumination optical system in the illumination device 100. The optical axis Cp and the optical axis C3 coincide with each other at least while the light from the light source unit 10 is emitted from the second optical unit 30 and is incident upon a different optical member. In the first embodiment, the optical axis C3 coincides with the optical axes C1 and C2. However, it is permissible even if the optical axis C3 is deviated from the optical axes C1 and C2. Namely, the optical axis of the third optical unit 40 and the optical axis of the different optical member may be either the same axis or different axes.

For example, the image light formation region 31 is formed of a light blocking plate as a mask pattern member having a certain opening. The image light formation region 31 may also be formed of a light blocking member including a plurality of images. In this case, with its own rotating operation, the image light formation region 31 is capable of forming the image light L31 having image information representing an image among a plurality of types of images. Further, the image light formation region 31 may be formed of a liquid crystal element (referred to also as a liquid crystal light bulb or a liquid crystal panel) that forms the image light based on an image signal, for example. Furthermore, the image light formation region 31 may be formed of a different optical component that forms the image light based on an image signal. The image light formation region 31 may be formed of a display element including a plurality of micro-mirrors such as a MEMS (Micro-Electro-Mechanical Systems) display element or a DMD (Digital Micromirror Device), for example.

The light transmissive region 32 may be formed of a light transmissive member, for example. Incidentally, the light transmissive region 32 may also be formed of a part of a light blocking plate formed to allow light to pass through, or an optical member, as a part of an optical member forming the image light based on an image signal, controlled to allow light to pass through based on the image signal at least at the time of the illumination function, for example. In this case, it is permissible even if there is no physical distinction between the image light formation region 31 and the light transmissive region 32.

The light L3 that passed through the second optical unit 30 is incident upon the third optical unit 40. When the first optical unit 20 is at the first position, the light L2 emitted from the first optical unit 20 mainly passes through the light transmissive region 32 arranged in the peripheral region of the second optical unit 30. In contrast, when the first optical unit 20 is at the second position, the light L2 emitted from the light distribution variable lens 21 mainly passes through the image light formation region 31 of the second optical unit 30.

The second optical unit 30 is supported by the gear 66. The drive unit 60 is capable of rotating the second optical unit 30 in the +RZ direction and the −RZ direction around the optical axis Cp (the optical axis C3 in this example) via the gear set (gears 66, 65 and 64 in this example) including the gear 66.

<Third Optical Unit 40>

Figure 4:
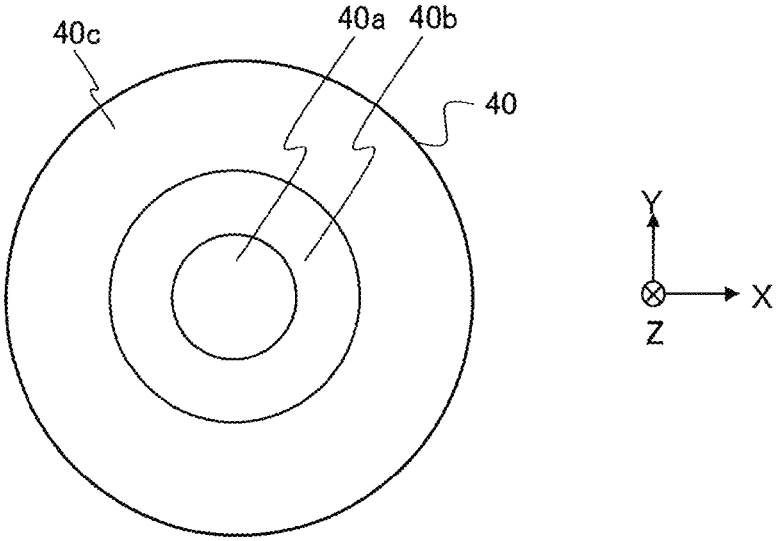
FIG. 4 is a diagram schematically showing a projection lens as a third optical unit of the illumination device according to the first embodiment.

FIG. 4 is a diagram schematically showing an optical member as the third optical unit 40. The third optical unit 40 forms illuminating light L4 from the light L3 emitted from the second optical unit 30. The illuminating light L4 is emitted forward, namely, in the +Z-axis direction, from the illumination device 100. The third optical unit 40 is a projection lens, for example. The third optical unit 40 is attached to an end part of the holding part 12 in the +Z-axis direction, for example.

The third optical unit 40 may have optical surfaces 40*a*, 40*b*, 40*c*, 40*d* and 40*e*. The optical surfaces 40*a* and 40*b* are light incidence surfaces. The light L3 emitted from the second optical unit 30 is incident upon the optical surfaces 40*a* and 40*b*. For example, the light L31 emitted from the image light formation region 31 is incident upon the optical surface 40*a*. Further, for example, the light L32 emitted from the light transmissive region 32 is incident upon the optical surface 40*b*. The optical surface 40*c* is a light-reflecting surface. The light that entered the third optical unit 40 is reflected by the optical surface 40*c*. For example, the light that entered the third optical unit 40 through the optical surface 40*b* is reflected by the optical surface 40*c*. The optical surfaces 40*d* and 40*e* are light emission surfaces. The light that entered the third optical unit 40 is emitted from the optical surfaces 40*d* and 40*e*. For example, the light that entered the third optical unit 40 through the optical surface 40*b* is reflected by the optical surface 40*c* and emitted from the optical surface 40*e*. Further, for example, the light that entered the third optical unit 40 through the optical surface 40*a* is emitted from the optical surface 40*d*. An optical surface 40*f* is a connection surface as a surface connecting the optical surface 40*d* and the optical surface 40*e*. The structure of the third optical unit 40 is not limited to that shown in FIG. 1 and FIG. 4.

Incidentally, while illustration is omitted, in the case where the illumination device 100 includes the third optical unit 40, the optical axis of the third optical unit 40 also constitutes a part of the optical axis Cp. The optical axis Cp and the optical axis of the third optical unit 40 coincide with each other at least while the light from the light source unit 10 is emitted from the third optical unit 40 and is incident upon a different optical member or is emitted from the illumination device 100. The optical axis of the third optical unit 40 and the optical axis of the different optical member may be either the same axis or different axes.

<Drive Unit 60>

The drive unit 60 includes a feed screw 62 and the slide nut 63 as a first mechanism that transforms rotary drive force generated by a motor 61 as a drive source into force that translates the first optical unit 20 (or its support member 25) in two directions (the traveling direction of the light and its opposite direction) along the optical axis C2 direction. Further, the drive unit 60 includes the feed screw 62 and the gears 64 to 66 as a second mechanism that transforms the rotary drive force generated by the motor 61 into force that rotates the second optical unit 30 in two directions (a +R direction and a −R direction) around the optical axis C3 as a rotation axis. The gear 64 forms a gear train that is connected to the gear 66 provided on the image light formation unit 30 via the gear 65 to be able to transmit the drive force. However, the number and the arrangement of the gears are not limited to the illustrated example. By driving the motor 61, the feed screw 62 is rotated, the slide nut 63 is moved and the gear 64 is rotated. By the rotation of the feed screw 62, the slide nut 63 is moved in a direction parallel to the optical axis C2, and the gear 66 is rotated around a rotation axis parallel to the optical axis C3 via the gear 64 and the gear 65.

<Control System>

Figure 5:
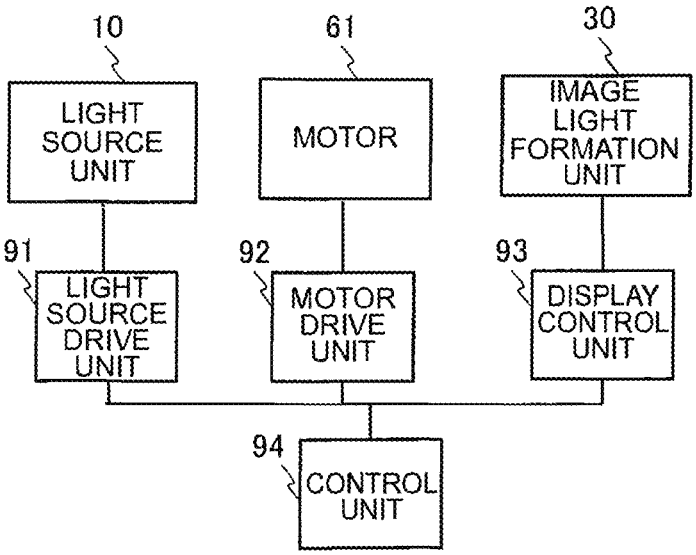
FIG. 5 is a functional block diagram schematically showing the configuration of a control system of the illumination device according to the first embodiment.

FIG. 5 is a functional block diagram schematically showing a configuration example of a control system of the illumination device 100. As shown in FIG. 5, the illumination device 100 may include, for example, the light source unit 10, a light source drive unit 91 that drives the light source unit 10, the motor 61, a motor drive unit 92 that drives the motor 61, the image light formation unit (second optical unit) 30, a display control unit 93 that drives the image light formation unit 30, and a control unit 94 that controls the whole of the device. For example, the light source drive unit 91 is a light source drive circuit, the motor drive unit 92 is a motor drive circuit, the display control unit 93 is a display control circuit, and the control unit 94 is a control circuit. All or part of the light source drive unit 91, the motor drive unit 92, the display control unit 93 and the control unit 94 may be implemented by a memory for storing a program and a processor for executing the program. Incidentally, in cases where the image light formation region 31 of the image light formation unit 30 is formed of a mask pattern member in which a mask region is fixed, the image light formation unit 30 and the display control unit 93 may be excluded from the control system.

(1-2) Operation of First Embodiment

FIG. 6 is a diagram showing principal rays of light when the first optical unit 20 is at the first position in the illumination device 100. When the first optical unit 20 is at the first position, the light L2 emitted from the first optical unit 20 mainly passes through the light transmissive region 32 of the second optical unit 30. The light that passed through the light transmissive region 32 (i.e., the light L32) mainly enters the third optical unit 40 through the optical surface 40*b*, is reflected by the optical surface 40*c*, and is emitted from the optical surface 40*e* as the illuminating light L4. When the first optical unit 20 is at the first position, most of the light L2 emitted from the first optical unit 20 passes through the light transmissive region 32 arranged in the peripheral region of the image light formation unit 30 and provided with no drawing of a symbol or the like, and thus the illumination device 100 emits illuminating light similar to the illuminating light from an ordinary illuminator.

Figure 7:
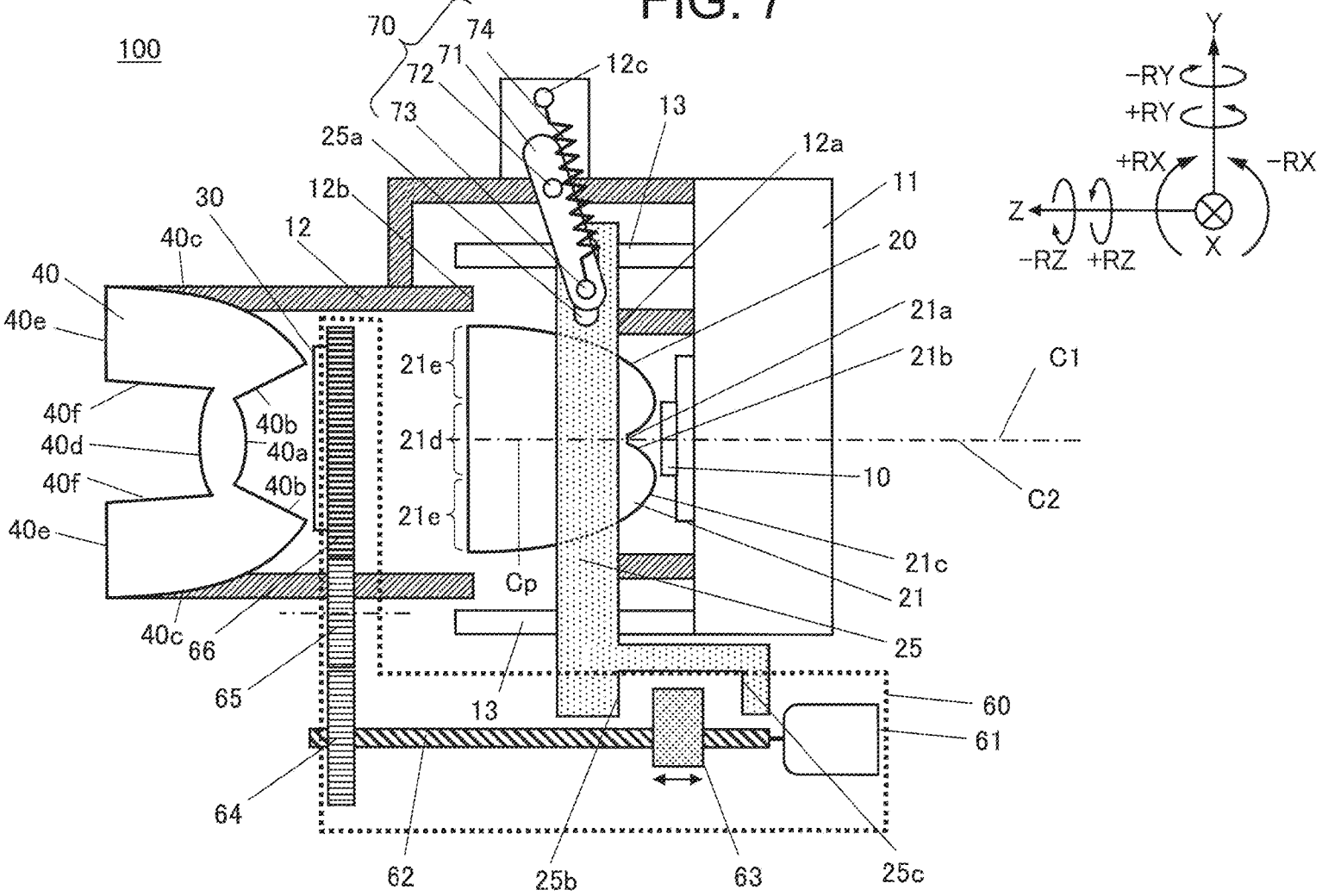
FIG. 7 is a side view showing a second operation of rotating the second optical unit while placing the first optical unit at the first position in the illumination device according to the first embodiment.
Figure 8:
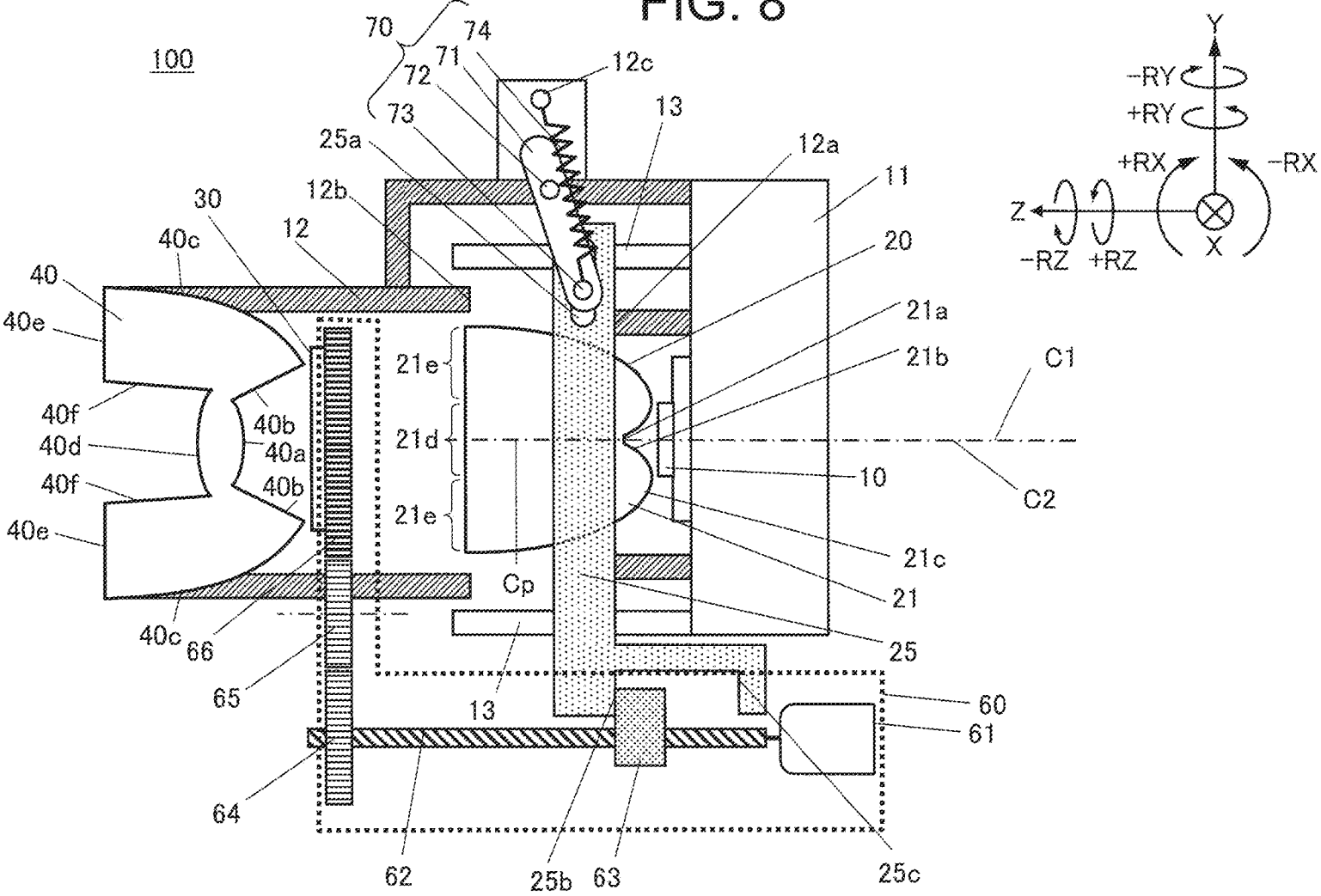
FIG. 8 is a side view showing a state when the first optical unit starts being moved in a +Z-axis direction from the first position by a drive unit in the illumination device according to the first embodiment.
Figure 11:
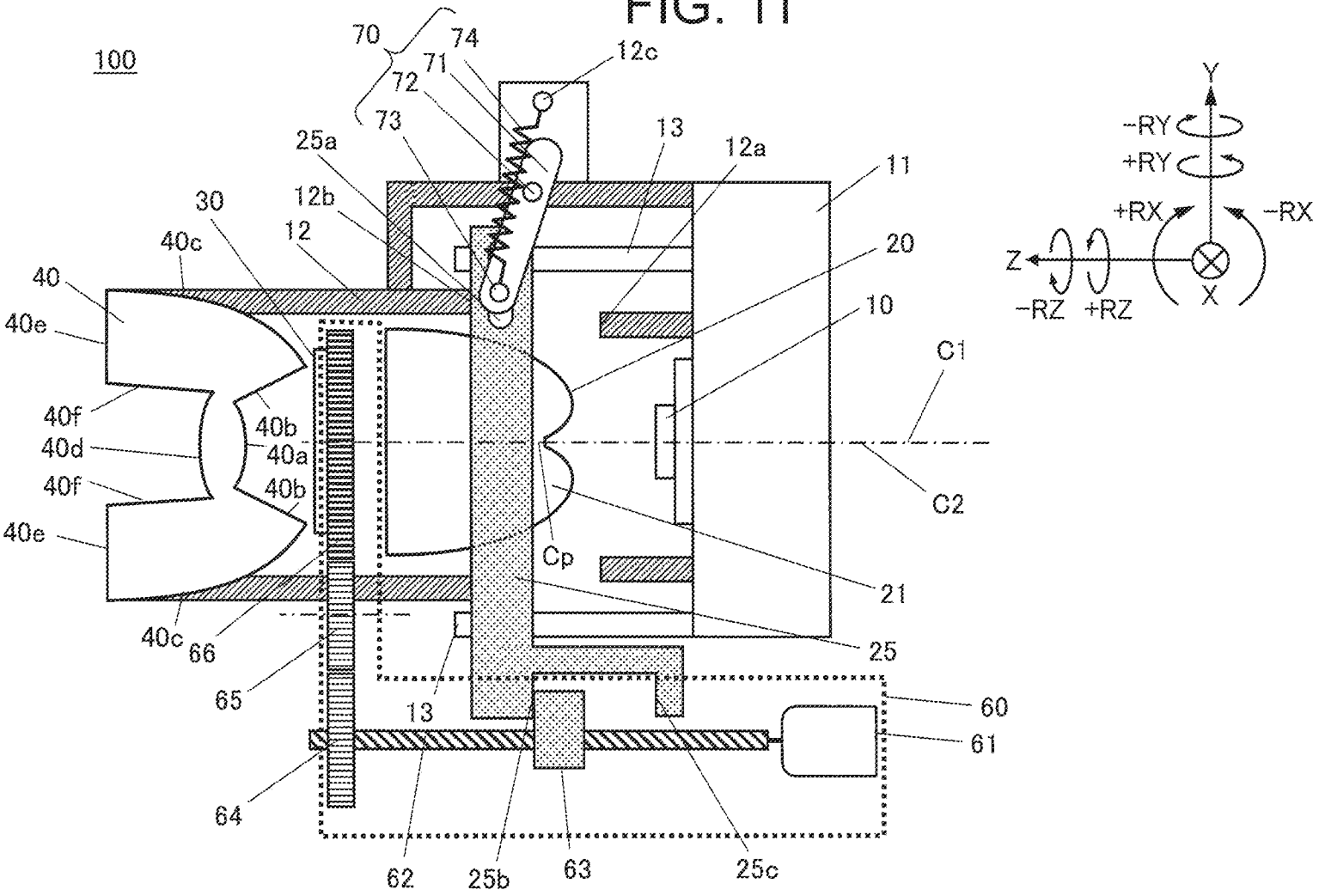
FIG. 11 is a side view showing a state in which a slide nut moved in the +Z-axis direction by the drive unit hits a support member of the first optical unit in the illumination device according to the first embodiment.

FIG. 7 to FIG. 11 are diagrams showing the first operation of moving the first optical unit 20 from the first position to the second position. FIG. 7 shows a state in which the first optical unit 20 is at the first position with the support member 25 of the first optical unit 20 in contact with the hit surface 12*a* of the holding part 12. FIG. 8 shows a state when the first optical unit 20 starts being moved in the +Z-axis direction from the first position by the drive unit 60. FIG. 9 shows a state in which the first optical unit 20 moved in the +Z-axis direction by the drive unit 60 has reached the first reference position. FIG. 10 shows a state in which the first optical unit 20 has been moved by the toggle mechanism 70 from the first reference position to the second position. FIG. 11 shows a state in which the slide nut 63 moved in the +Z-axis direction by the drive unit 60 hits the hit surface 25*b* of the support member 25 of the first optical unit 20.

When the slide nut 63 is moved in the +Z-axis direction by driving the motor 61, the image light formation unit 30 rotates around the Z-axis while the slide nut 63 moves in the +Z-axis direction as shown in FIG. 7. At that time, the slide nut 63 does not hit the hit surface 25*b* or the hit surface 25*c* of the support member 25 of the first optical unit 20. In this case, the drive unit 60 is capable of rotating the second optical unit 30 including the image light formation region 31 while placing the first optical unit 20 at the first position. Incidentally, in this example, there is no problem even if the second optical unit 30 including the image light formation region 31 rotates since most of the light emitted from the first optical unit 20 passes through the light transmissive region 32 of the second optical unit 30 when the first optical unit 20 is at the first position.

When the slide nut 63 is moved further in the +Z-axis direction by driving the motor 61, the slide nut 63 hits the hit surface 25*b* of the support member 25 of the first optical unit 20 as shown in FIG. 8. When the slide nut 63 is moved further in the +Z-axis direction by driving the motor 61, the slide nut 63 pushes the hit surface 25*b* of the support member 25 of the first optical unit 20 in the +Z-axis direction and the first optical unit 20 reaches the first reference position where the fixation part 12*c*, the spindle 72 and the pin 73 are aligned on one straight line as shown in FIG. 9.

When the slide nut 63 is moved further in the +Z-axis direction by further driving the motor 61, force in the +Z direction is applied by the toggle mechanism 70 to the support member 25 of the first optical unit 20 and the support member 25 moves to the second position as shown in FIG. 10. Thereafter, when the slide nut 63 is moved further in the +Z-axis direction by driving the motor 61, the slide nut 63 moves further in the +Z-axis direction and stops moving when hitting the hit surface 25*b* of the support member 25 of the first optical unit 20 as shown in FIG. 11. Even when the power of the motor 61 turns off, the first optical unit 20 is capable of remaining stopped at the second position thanks to the feed screw 62.

FIG. 12 is a diagram showing principal rays of light when the first optical unit 20 is at the second position in the illumination device 100. When the first optical unit 20 is at the second position, the light L2 emitted from the first optical unit 20 (the light distribution variable lens 21 in this example) mainly passes through the image light formation region 31 of the second optical unit 30. The light L3 including the image light L31 that passed through the image light formation region 31 mainly enters the third optical unit 40 through the optical surface 40*a* and is emitted from the optical surface 40*d* as the illuminating light L4 including the image light. When the first optical unit 20 is at the second position, most of the light L2 emitted from the first optical unit 20 passes through the image light formation region 31 of the second optical unit 30, that is, a mask pattern region in which a symbol or the like has been drawn, and thus the illumination device 100 is usable as a signage illuminator that displays an image including a symbol or the like.

Figure 13:
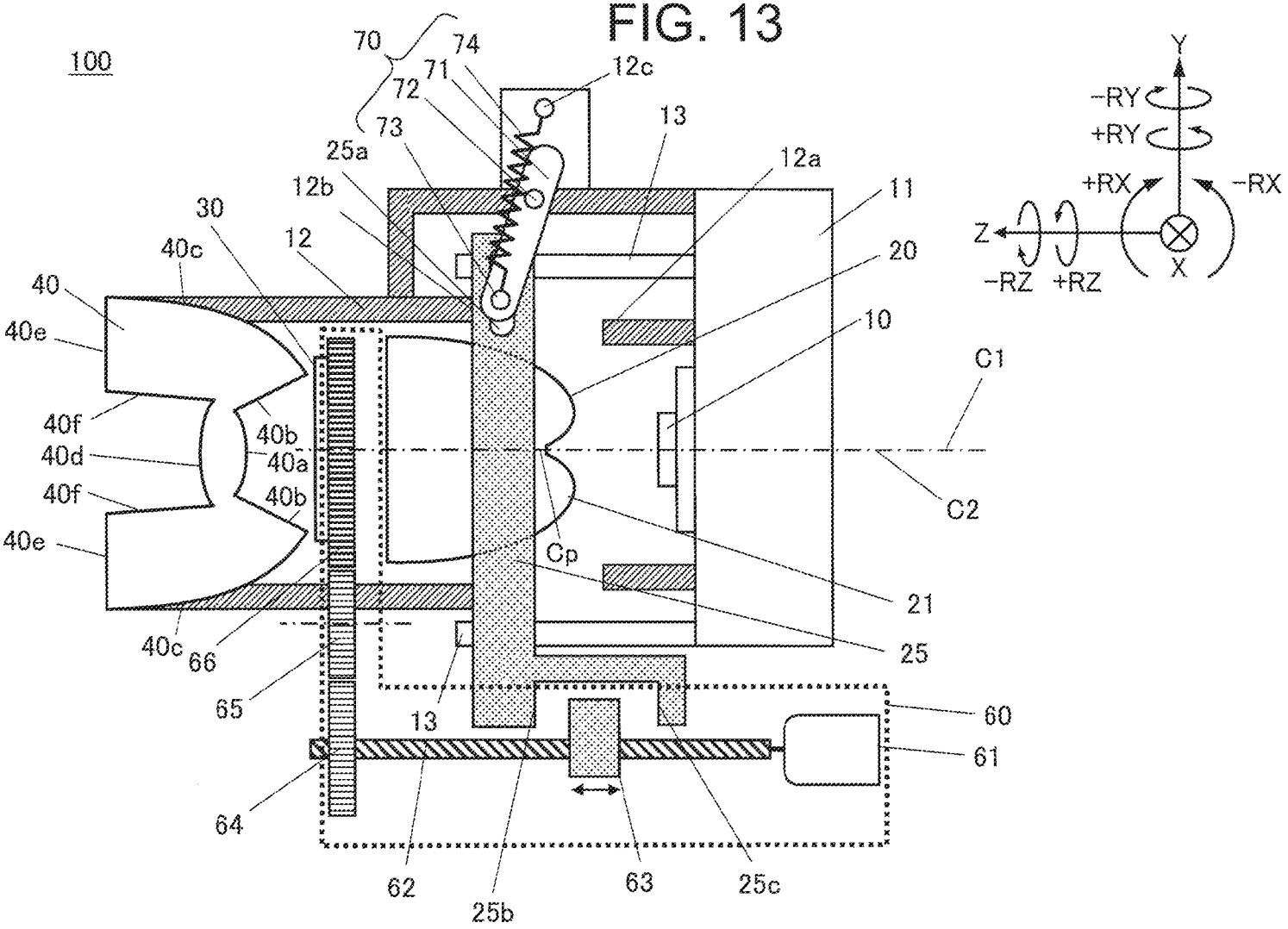
FIG. 13 is a side view showing a second operation of rotating the second optical unit while placing the first optical unit at the second position in the illumination device according to the first embodiment.

FIG. 13 is a side view showing the second operation of rotating the second optical unit 30 while placing the first optical unit 20 at the second position. When the slide nut 63 is moved in the Z-axis direction by driving the motor 61, the second optical unit 30 rotates. By moving the slide nut 63 in the Z-axis direction so that the slide nut 63 does not hit the hit surface 25*b* or the hit surface 25*c* of the support member 25 of the first optical unit 20, the drive unit 60 is capable of executing the second operation of rotating the second optical unit 30 while placing the first optical unit 20 at the second position.

In this example, when the first optical unit 20 is at the second position, most of the light emitted from the first optical unit 20 passes through the image light formation region 31 of the second optical unit 30, turns into the light L3 including the image light L31, and enters the third optical unit 40. Consequently, the image is projected onto the illuminated surface. By rotating the second optical unit 30 including the image light formation region 31 in this state, the direction of the image projected on the illuminated surface can be changed (adjusted). In the second operation, it is desirable if the second optical unit 30 can be rotated by one turn or more while placing the first optical unit 20 at the second position. With this configuration, the direction of the image indicated by the image light formed by the image light formation region 31 can be adjusted to any intended direction, for example.

Figure 14:
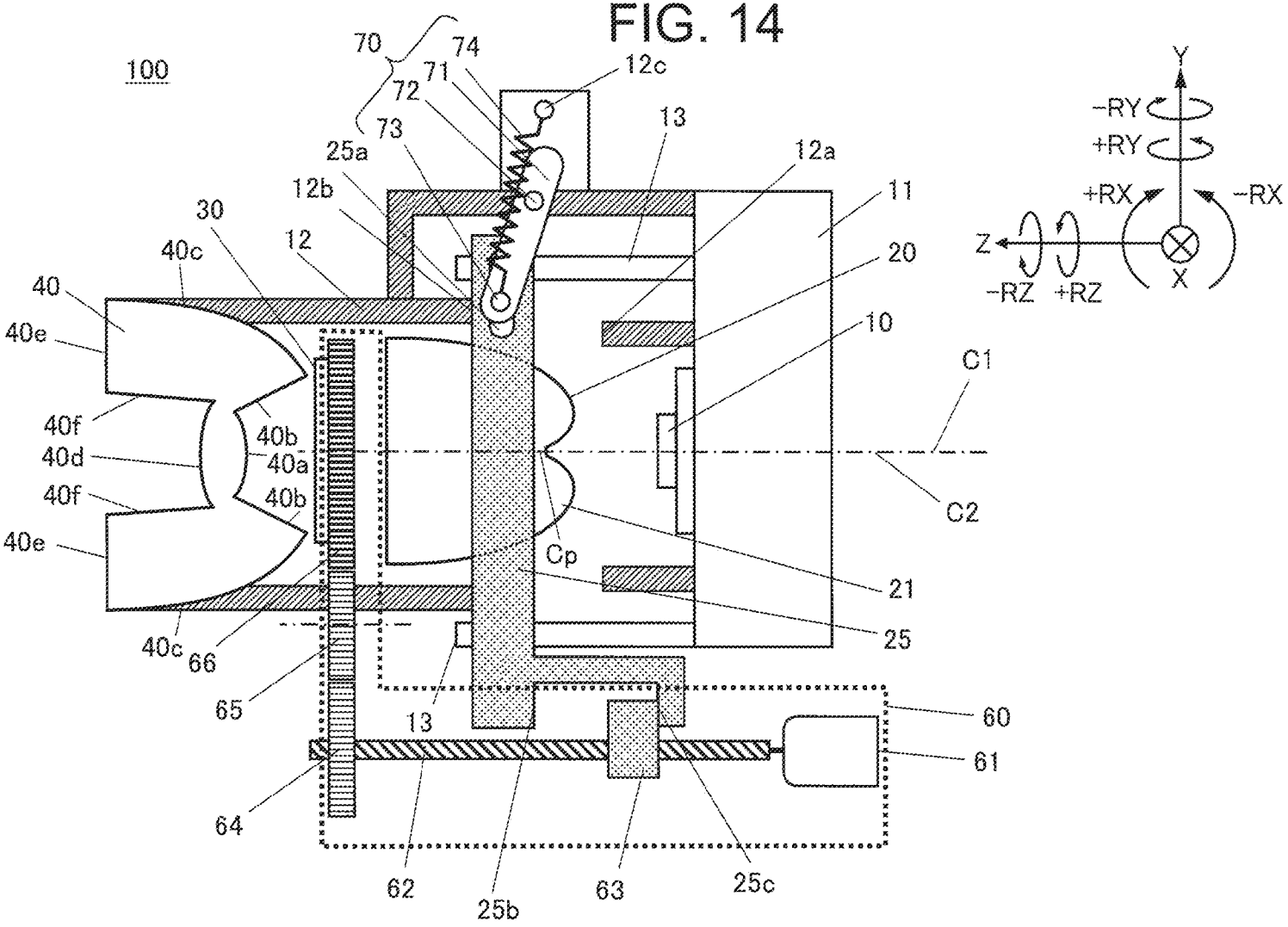
FIG. 14 is a side view showing a state when the first optical unit starts being moved in a −Z-axis direction by the drive unit in the illumination device according to the first embodiment.
Figure 16:
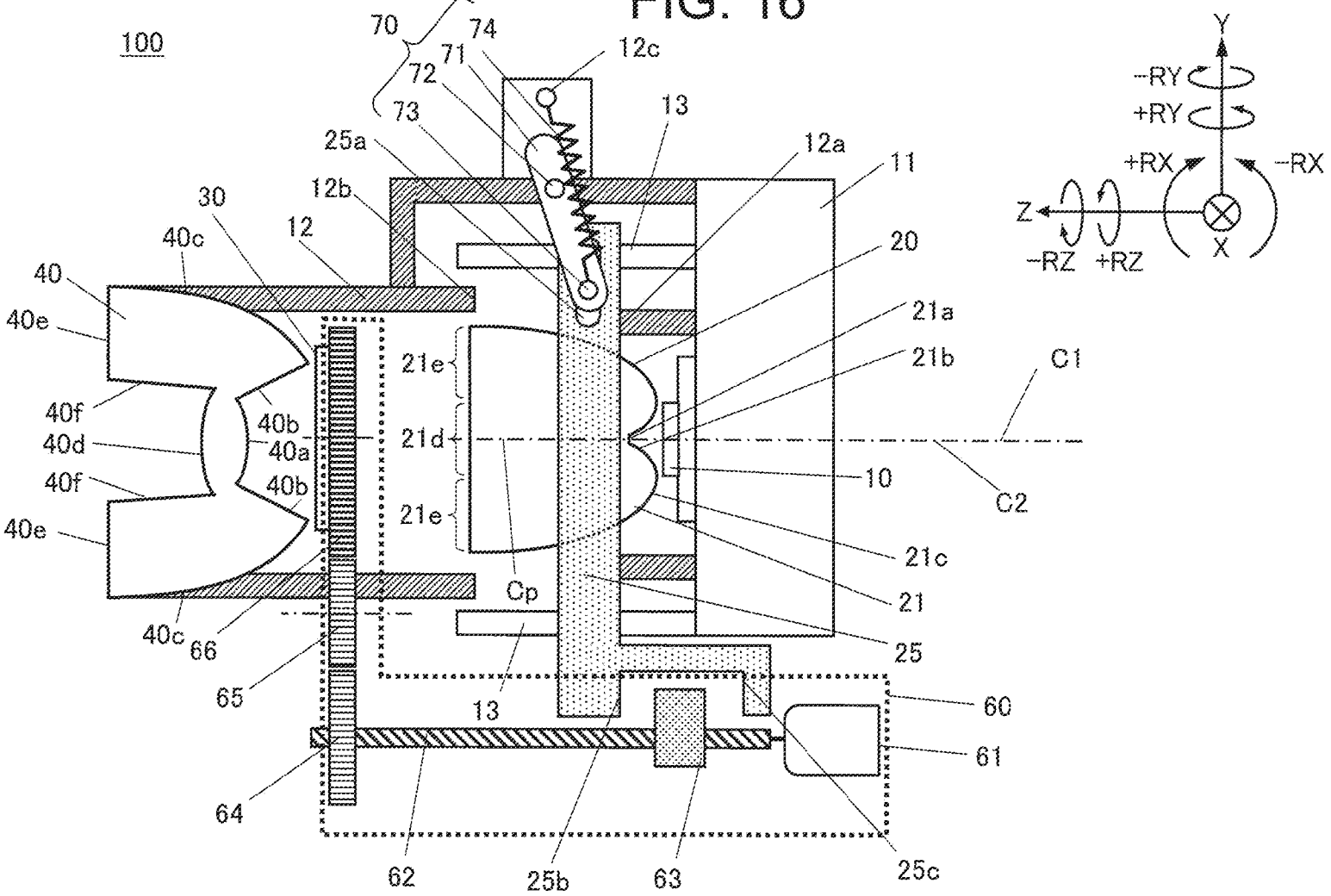
FIG. 16 is a side view showing a state in which the first optical unit has been moved by the toggle mechanism from the second reference position to the first position in the illumination device according to the first embodiment.

FIGS. 14 to 16 are diagrams showing the first operation of moving the first optical unit 20 from the second position to the first position. FIG. 14 shows a state when the first optical unit 20 starts being moved in the −Z-axis direction from the second position by the drive unit 60. FIG. 15 shows a state in which the first optical unit 20 moved in the −Z-axis direction by the drive unit 60 has reached the second reference position. FIG. 16 shows a state in which the light distribution variable lens 21 has been moved by the toggle mechanism 70 from the second reference position to the first position.

When the slide nut 63 is moved in the −Z-axis direction by driving the motor 61, the slide nut 63 hits the hit surface 25*c* of the support member 25 of the first optical unit 20 as shown in FIG. 14. When the slide nut 63 is moved further in the −Z-axis direction by driving the motor 61, the slide nut 63 pushes the hit surface 25*c* of the support member 25 of the first optical unit 20 in the −Z-axis direction and the first optical unit 20 reaches the second reference position where the fixation part 12*c*, the spindle 72 and the pin 73 are aligned on one straight line as shown in FIG. 15. Incidentally, in this example, the first reference position and the second reference position are the same position. When the slide nut 63 is moved further in the −Z-axis direction by driving the motor 61, the first optical unit 20 is moved by the toggle mechanism 70 to the first position as shown in FIG. 16. Thereafter, when the slide nut 63 is moved further in the −Z-axis direction by driving the motor 61, the slide nut 63 moves further in the −Z-axis direction and stops moving when hitting the hit surface 25*c* of the support member 25 of the first optical unit 20 as shown in FIG. 1. Even when the power of the motor 61 turns off, the first optical unit 20 is capable of remaining stopped at the first position thanks to the feed screw 62.

The illumination device 100 in this example includes not only the drive unit 60 that moves the first optical unit 20 in the optical axis Cp direction but also a stopper part (the hit surfaces 12*a* and 12*b*) as a stop mechanism for stopping the movement of the first optical unit 20 at the movement ends, and thus the first optical unit 20 stops the movement at each movement end by making contact with the stopper part and the second optical unit 30 is capable of continuing the rotating operation by the continuous operation of the drive source even after the stoppage of the first optical unit 20. Further, the illumination device 100 can further include the toggle mechanism 70 as a biasing member for biasing the first optical unit 20 in a movement end direction as described above, as a moving mechanism for the first optical unit 20.

The illumination device 100 is used as a generic illuminator emitting light like the light from an ordinary downlight when the first optical unit 20 is at the first position, and the illumination device 100 is used as a signage illuminator when the first optical unit 20 is at the second position. However, the illumination device 100 can also be configured to operate as a generic illuminator emitting light like the light from an ordinary downlight when the first optical unit 20 is at the second position and operate as a signage illuminator when the first optical unit 20 is at the first position.

Further, while the image light formation region 31 is arranged at the center of the second optical unit 30 and the light transmissive region 32 is arranged around the image light formation region 31 in the above-described example, it is also possible to arrange the light transmissive region 32 at the center of the second optical unit 30 and arrange the image light formation region 31 around the light transmissive region 32, for example.

(1-3) Effect of First Embodiment

As described above, with the illumination device 100 according to the first embodiment, different functions can be provided to be switchable and with high functionality by using the rotary drive force of one motor 61. More specifically, it is possible to provide the illumination device 100 having the function as a generic illuminator and the function as a signage illuminator to be switchable and with high functionality such as the capability of freely setting the direction of the projected image when operating as a signage illuminator. Incidentally, while the capability of freely setting the direction of the image is taken above as an example of the high functionality, it is also possible to take other examples of the high functionality such as the capability of quickly executing the switching operation and the capability of changing the light distribution pattern of the illuminating light when operating as a generic illuminator.

(2) SECOND EMBODIMENT

(2-1) Configuration of Second Embodiment

Figure 17:
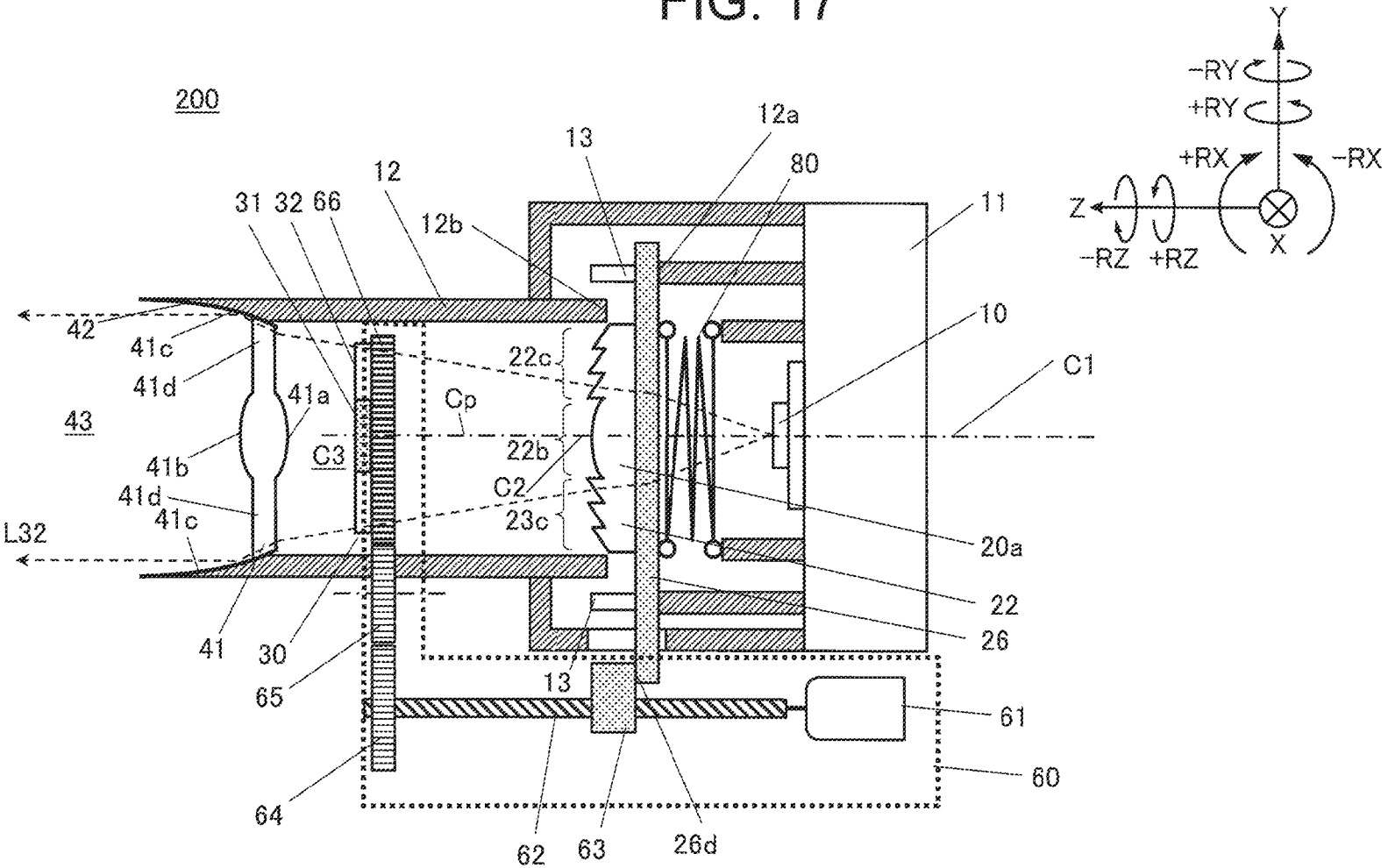
FIG. 17 is a side view showing a state when the first optical unit is at the first position in an illumination device according to a second embodiment of the present invention.
Figure 18:
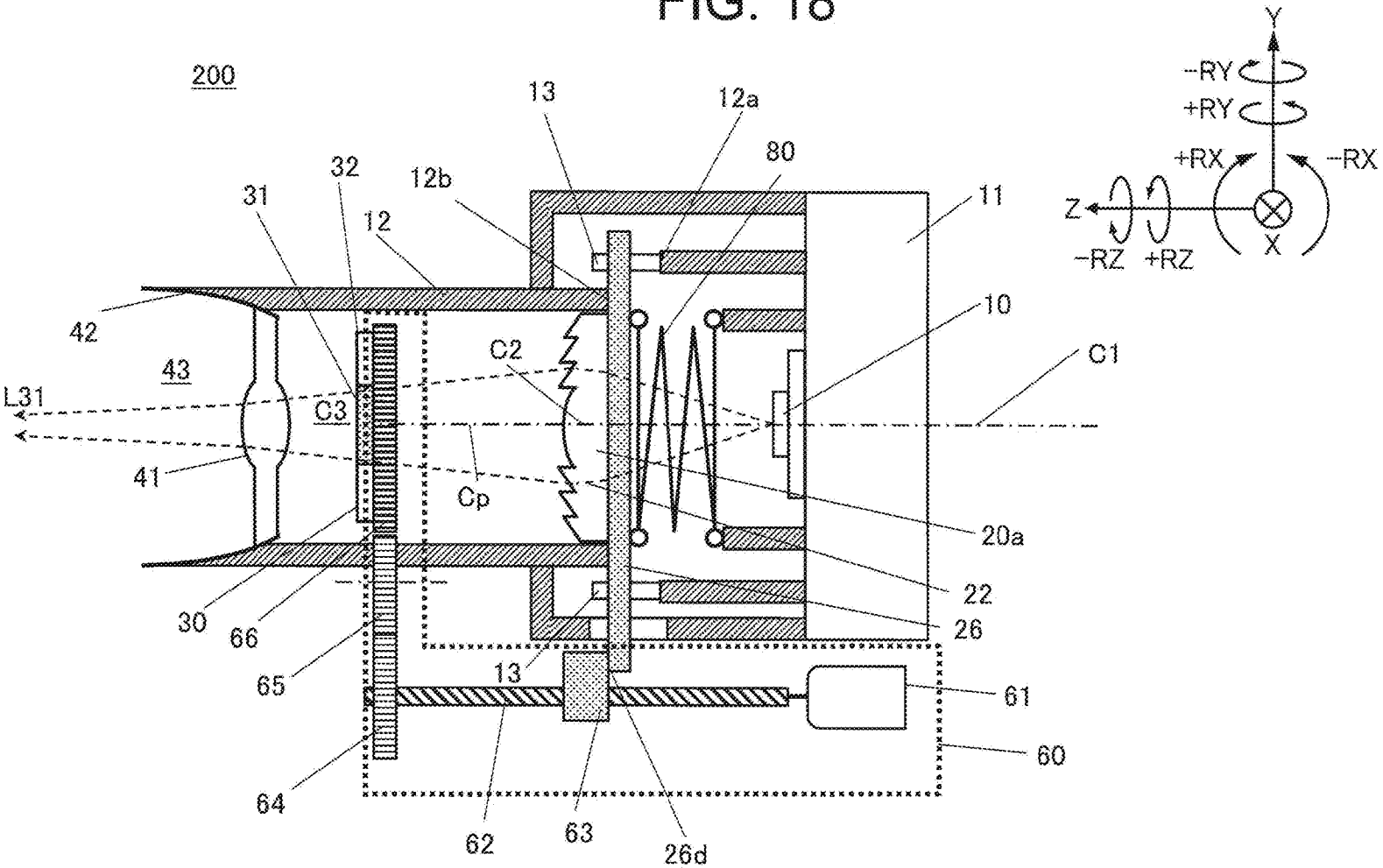
FIG. 18 is a side view showing a state when the first optical unit is at the second position in the illumination device according to the second embodiment.
Figure 19:
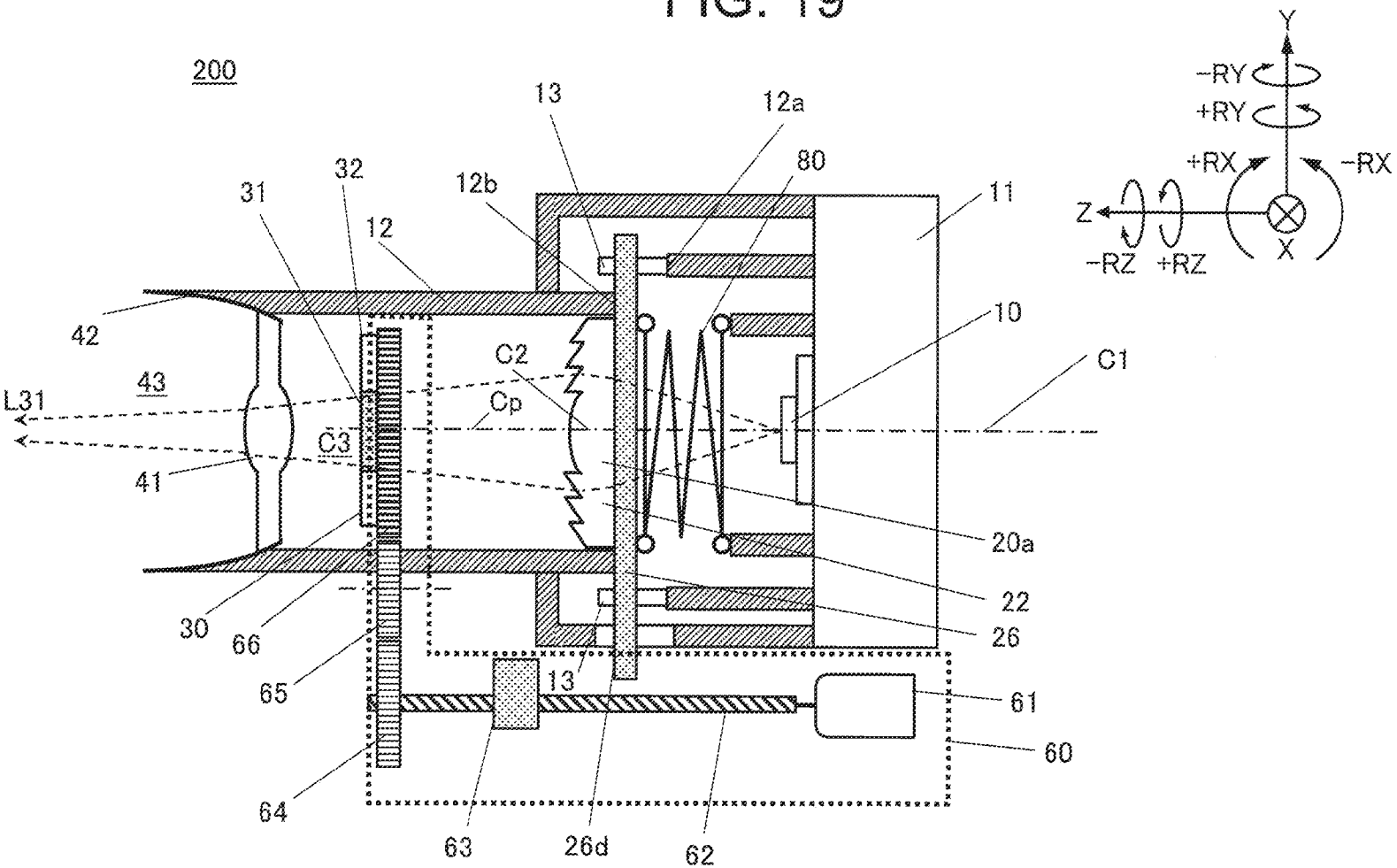
FIG. 19 is a side view showing the second operation of rotating the second optical unit while placing the first optical unit at the second position in the illumination device according to the second embodiment.

FIG. 17 to FIG. 19 are side views schematically showing internal structure of an illumination device 200 according to the second embodiment. FIG. 17 shows a state in which a first optical unit 20*a* (a light distribution variable lens 22 in this example) is at the first position. FIG. 18 shows a state in which the first optical unit 20*a* is at the second position. FIG. 19 shows the second operation of rotating the second optical unit 30 while placing the first optical unit 20*a* at the second position.

As shown in FIG. 17 to FIG. 19, the illumination device 200 includes the light source unit 10 that emits the light L1 as the first light and the first optical unit 20*a* that is supported to be movable along the optical axis Cp (in the +Z-axis direction and the −Z-axis direction in this example) and changes the divergence angle of the first light.

The first optical unit 20*a* can be a light distribution variable lens 22 as a light distribution variable member. Further, similarly to the first example, the first optical unit 20*a* can also be an optical unit including the light distribution variable lens 22 as the light distribution variable member and a support member 26 that supports the light distribution variable lens 22 to be linearly movable in the direction of the optical axis Cp of the optical system (in the direction of the optical axis C2 of the first optical unit 20*a* in this example).

The illumination device 200 is capable of changing the light distribution pattern of the light emitted from the first optical unit 20*a* by moving the first optical unit 20*a* in the optical axis Cp direction to change the distance between the light source unit 10 and the first optical unit 20*a*. The light distribution variable lens 22 can be a condensing lens or a Fresnel lens having the function of the condensing lens. The light distribution variable lens 22 in this example includes a lens part 22*b* having a front surface in a curved surface shape and arranged at the center and a prism part 22*c* arranged around the lens part 22*b*. The light distribution variable member may be formed with a combination of a plurality of lens elements. The light distribution variable member may also be formed with a reflecting mirror instead of the light distribution variable lens.

Further, the illumination device 200 includes the second optical unit 30. The second optical unit 30 may be the same as that in the first embodiment.

Furthermore, the illumination device 200 may further include a third optical unit 43. Similarly to the third optical unit 40 in the first embodiment, the third optical unit 43 receives the light L3 that passed through the second optical unit 30 and emits the illuminating light (light L4) heading for the illuminated surface. The third optical unit 43 is a projection lens, for example. The third optical unit 43 may be formed with a combination of a plurality of lens elements. The third optical unit 43 may also be formed with a reflecting mirror or a combination of a reflecting mirror and a lens. In FIG. 17, the third optical unit 43 includes a lens part 41 and a reflector part 42. The reflector part 42 is a concave mirror, for example. Specifically, the reflector part 42 can be a spheroidal mirror, a revolution paraboloidal mirror or the like.

The third optical unit 43 projects the light emitted from the second optical unit 30 in the forward direction (i.e., in the +Z-axis direction) from the illumination device 200. The third optical unit 43 may be attached to an end part of the holding part 12 in the +Z-axis direction, for example.

Further, the third optical unit 43 includes optical surfaces 41*a*, 41*b* and 41*c* and a support part 41*d* having light permeability, for example. The optical surface 41*a* is a light incidence surface. For example, the light L31 emitted from the image light formation region 31 of the second optical unit 30 is incident upon the optical surface 41*a*. The optical surface 41*b* is a light emission surface. The optical surface 41*c* is a reflecting surface of the reflector part 42. The support part 41*d* supports the lens part 41 including the optical surfaces 41*a* and 41*b* on the reflector part 42. Incidentally, the structure of the third optical unit 43 is not limited to the illustrated structure.

The illumination device 200 further includes an elastic member 80 that applies force in a moving direction of the first optical unit 20*a* (in this example, one of the +Z-axis direction and the −Z-axis direction (the +Z-axis direction in this example)) to the support member 26 supporting the first optical unit 20*a*. For example, the elastic member 80 is a coil spring that applies pressing force in one of the moving directions to the support member 26. The elastic member 80 is not limited to that shown in FIG. 17 as long as the member applies pressing force in a predetermined direction to the support member 26. For example, the elastic member 80 can be a member that is supported by the holding part 12 situated on the emission direction side of the support member 26 and applies pressing force in the −Z-axis direction to the support member 26.

Furthermore, the illumination device 200 includes the drive unit 60 that moves the first optical unit 20*a* and the second optical unit 30. The structure of the drive unit 60 is the same as that in the illumination device 100 according to the first embodiment. The drive unit 60 in this example includes the feed screw 62 and the slide nut 63 as the first mechanism that transforms the rotary drive force generated by the motor 61 into force that moves the first optical unit 20*a* in a direction (the −Z-axis direction in this example) opposite to the pressing force applied by the elastic member 80. Namely, the first mechanism transforms the rotation of the feed screw 62 around one axis generated by the motor 61 (rotation in the +RZ direction and the −RZ direction) into the linear movement of the slide nut 63 along the optical axis Cp (in the +Z-axis direction and the −Z-axis direction). A surface of the slide nut 63 facing the −Z-axis direction (the direction opposite to the pressing force applied to the support member 26 by the elastic member 80) hits the support member 26.

Further, the drive unit 60 includes the feed screw 62 and the gears 64 to 66 as the second mechanism that transforms the rotary drive force generated by the motor 61 into force that rotates the second optical unit 30 around the optical axis Cp (in the +RZ direction and the −RZ direction). Namely, the second mechanism transmits the rotation of the feed screw 62 around one axis generated by the motor 61 while transforming the rotation into the force that rotates the second optical unit 30 around the optical axis Cp (in the +RZ direction and the −RZ direction) by using the gears 64 to 66.

(2-2) Operation of Second Embodiment

When the feed screw 62 is rotated by driving the motor 61, the slide nut 63 and the gear 64 are driven at the same time. By the rotation of the feed screw 62, the slide nut 63 is moved in a direction parallel to the optical axis Cp (more specifically, the optical axis C2 of the first optical unit 20*a*) and the second optical unit 30 is rotated around the optical axis Cp (more specifically, the optical axis C3 of the second optical unit 30) via the gear 64, the gear 65 and the gear 66.

When the slide nut 63 is moved in the −Z-axis direction by driving the motor 61 as shown in FIG. 17, a surface of the slide nut 63 facing the −Z-axis direction hits a hit surface 26*d* provided on the support member 26 of the first optical unit 20*a* (the light distribution variable lens 22 in this example) and the light distribution variable lens 22 moves in the −Z-axis direction. At that time, the first optical unit 20*a* moves in the −Z-axis direction while resisting to the pressing force in the +Z-axis direction received from the elastic member 80. Incidentally, in this example, the −Z-axis direction is illustrated as one of the axial directions parallel to the optical axis Cp that faces the light source's side.

When a surface of the support member 26 supporting the first optical unit 20*a* that faces the −Z-axis direction hits the hit surface 12*a* of the holding part 12, the support member 26 cannot move in the −Z-axis direction any more. The stopping position in this case is the first position of the first optical unit 20*a* in the illumination device 200.

The first position of the first optical unit 20*a* in the illumination device 200 is determined by the pinching of the support member 26 by the slide nut 63 and the hit surface 12*a*. However, the first position of the first optical unit 20*a* may also be set by a state in which the force in the −Z-axis direction by the slide nut 63 and the force in the +Z-axis direction by the elastic member 80 are in balance with each other. In this case, the hit surface 12*a* is not used for the setting of the first position.

When the light distribution variable lens 22 as the first optical unit 20*a* in this example is at the first position, the light emitted from the light distribution variable lens 22 passes through the light transmissive region 32 of the second optical unit 30. Thus, the illumination device 200 emits illuminating light similar to that from an ordinary downlight, for example, and is usable as a generic illuminator. Further, even when the power of the motor 61 turns off, the first optical unit 20*a* is capable of remaining stopped at the first position thanks to the feed screw 62.

When the slide nut 63 is moved in the +Z-axis direction by driving the motor 61 as shown in FIG. 18, the first optical unit 20*a* moves in the +Z-axis direction while contacting the surface of the slide nut 63 facing the −Z-axis direction due to the pressing force of the elastic member 80 in the +Z-axis direction.

As the slide nut 63 is continuously moved in the +Z-axis direction by driving the feed screw 62, a surface of the support member 26 facing the +Z-axis direction hits the hit surface 12*b* provided on the holding part 12 and the support member 26 cannot move in the +Z-axis direction any more. At that time, the first optical unit 20*a* is situated at the second position.

When the light distribution variable lens 22 as the first optical unit 20*a* in this example is at the second position, the light emitted from the light distribution variable lens 22 passes through the image light formation region 31 of the second optical unit 30. Thus, the illumination device 200 is usable as a signage illuminator that displays an image including a symbol or the like, for example.

Further, as shown in FIG. 19, even when the power of the motor 61 turns off, the first optical unit 20*a* is capable of remaining situated at the second position thanks to the feed screw. Furthermore, even after the movement of the first optical unit 20*a* in the +Z-axis direction is disabled, the slide nut 63 is capable of moving in the +Z-axis direction and separating from the first optical unit 20*a* by the movement.

Even after the separation of the slide nut 63 from the first optical unit 20*a*, the first optical unit 20*a* is capable of remaining situated at the second position thanks to the elastic member 80.

When the first optical unit 20*a* is situated at the second position and an end part of the slide nut 63 in the −Z-axis direction is situated in the +Z-axis direction from the hit surface 12*b* of the holding part 12 according to the above-described relationship, the rotating operation of the motor 61 serves as an operation just for applying the force for the rotation of the second optical unit 30 around the optical axis Cp. Namely, in this period, the first optical unit 20*a* remains at the second position and thus the illumination device operates in a mode of projecting the image light (L3) to be rotatable according to the operation of the motor 61, that is, projecting the image indicated by the image light (L3) in any intended direction.

Incidentally, it is also possible to employ a configuration that can be used as a signage illuminator when the first optical unit 20*a* is at the first position and used as an ordinary illuminator when the first optical unit 20*a* is at the second position. For example, the elastic member 80 is arranged on the +Z-axis direction side of the first optical unit 20*a* and the surface of the slide nut 63 facing the +Z-axis direction is arranged so as to hit the surface of the support member 26 of the light distribution variable lens 22 facing the −Z-axis direction. With such structure, the support member 26 receives pressing force in the −Z-axis direction from the elastic member 80 and is moved by force in the +Z-axis direction from the slide nut 63.

(2-3) Effect of Second Embodiment

As described above, also with the illumination device 200 according to the second embodiment, effects similar to those in the first embodiment can be obtained. Namely, different functions can be provided to be switchable and with high functionality by using the rotary drive force of one motor 61. More specifically, it is possible to provide the illumination device 200 having the function as a generic illuminator and the function as a signage illuminator to be switchable and with high functionality such as the capability of freely setting the direction of the projected image when operating as a signage illuminator. Incidentally, while the capability of freely setting the direction of the image is taken above as an example of the high functionality, it is also possible to take other examples of the high functionality such as the capability of quickly executing the switching operation and the capability of changing the light distribution pattern of the illuminating light when operating as a generic illuminator.

(3) THIRD EMBODIMENT

Figure 20:
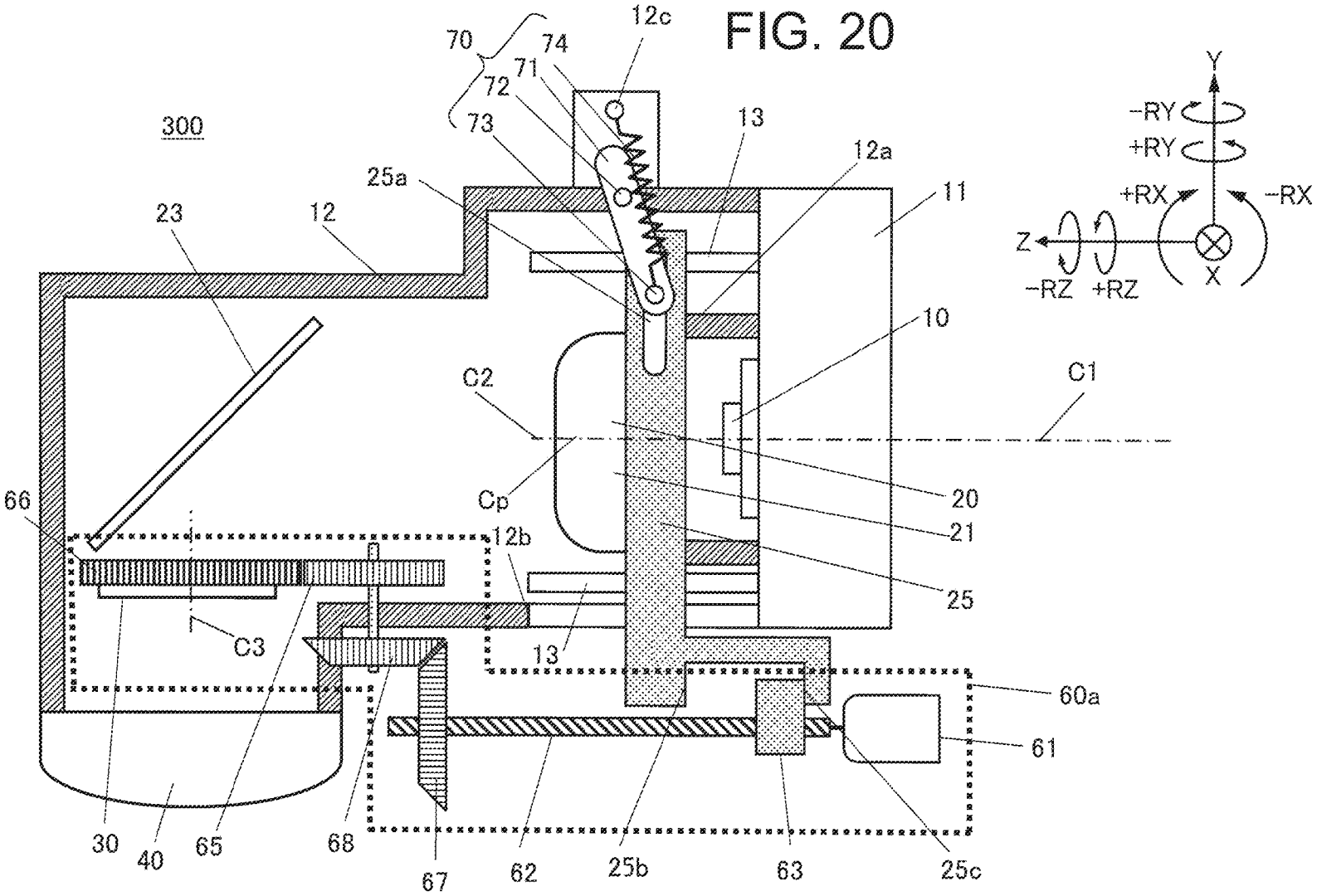
FIG. 20 is a side view schematically showing internal structure of an illumination device according to a third embodiment of the present invention.

FIG. 20 is a side view schematically showing internal structure of an illumination device 300 according to the third embodiment. In FIG. 20, each component identical or corresponding to a component shown in FIG. 1 is assigned the same reference character as in FIG. 1. Incidentally, while the first optical unit 20 and the third optical unit 40 in FIG. 20 are shown in a simplified manner, the functions of these components are the same as those of the components shown in FIG. 1.

The illumination device 300 differs from the illumination device 100 in including a reflecting mirror 23 as an optical path changing member and bevel gears 67 and 68 as drive force transmission members. Further, a drive unit 60*a* of the illumination device 300 includes the bevel gear 67 instead of the gear 64 provided on the feed screw 62 in the drive unit 60.

The reflecting mirror 23 reflects the light emitted from the first optical unit 20, thereby changes the traveling direction of the light, and makes the light enter the second optical unit 30.

The illumination device 300, being similar to the illumination device 100 in holding the second optical unit 30 to be rotatable around the optical axis Cp (more specifically, the optical axis Cp of the second optical unit 30), differs from the illumination device 100 in that the optical axis Cp is in the Y-axis direction at the time point when the light enters the second optical unit 30 differently from the optical axis C1 of the light source unit 10 and the optical axis C2 of the first optical unit 20. In the illumination device 300 in this example, the second optical unit 30 is held to be rotatable around the Y-axis. Therefore, the holding part 12 is provided with the gear 66 and the gear 65 to be rotatable around the Y-axis. In the example shown in FIG. 20, the gear 65 is provided with the gear 68, and the gear 65 and the gear 68 are coaxially linked with each other and rotate in sync with each other.

In this example, the motor 61 has rotary drive force around an axis (Z-axis) parallel to the optical axis C2 of the first optical unit 20. The bevel gears 67 and 68 form a mechanism capable of transforming the rotary drive force around the Z-axis generated by the motor 61 into rotary drive force around the optical axis C3 (Y-axis). The bevel gears 67 and 68 are engaged with each other and the rotary drive force of the feed screw 62 is transmitted via the bevel gears 67 and 68 as rotary drive force for rotating the second optical unit 30 around the optical axis C3.

In regard to the other features, the illumination device 300 is the same as the illumination device 100 or the illumination device 200.

As described above, also with the illumination device 300 according to the third embodiment, effects similar to those in the first embodiment can be obtained. Namely, different functions can be provided to be switchable and with high functionality by using the rotary drive force of one motor 61. More specifically, it is possible to provide the illumination device 300 having the function as a generic illuminator and the function as a signage illuminator to be switchable and with high functionality such as the capability of freely setting the direction of the projected image when operating as a signage illuminator. Incidentally, while the capability of freely setting the direction of the image is taken above as an example of the high functionality, it is also possible to take other examples of the high functionality such as the capability of quickly executing the switching operation and the capability of changing the light distribution pattern of the illuminating light when operating as a generic illuminator. Further, the illumination device 300 is capable of setting the direction of the illuminating light projected by the reflecting mirror 23 at a direction other than the Z-axis direction that is the light emission direction of the light source unit 10. Incidentally, while the reflecting mirror is provided between the first optical unit 20 and the second optical unit 30 in the above-described configuration, the position of the reflecting mirror is not limited to this position. For example, it is possible to provide a reflecting mirror between the light source unit 10 and the first optical unit 20 instead of or in addition to the above-described configuration.

(4) MODIFICATION

The structure of the drive unit 60 or 60*a* in the first to third embodiments can be modified in various ways. For example, the drive unit 60 or 60*a* can be formed with a mechanism using a belt pulley, a mechanism using a friction gear, a mechanism using a rack and pinion, or the like.

Further, the third optical unit 43 including the lens part 41 and the reflector part 42 described in the second embodiment may be applied to the illumination device 100 or 300 in the first or third embodiment.

(5) APPENDIXES

Based on the above embodiments, the contents of the present invention will be described below as appendixes.

Appendix 1

An illumination device (100, 300) comprising:

a light source unit (10) that emits light (L1);

a first optical unit (20) that lets the light (L1) enter and changes a divergence angle of the entered light (L1);

a second optical unit (30) including an image light formation region (31) that lets the light (L2) with the changed divergence angle enter and emits light (L31) including image light having image information;

a drive unit (60, 60*a*) that moves the first optical unit (20) and the second optical unit (30);

a first support member (25) that supports the first optical unit (20) to be movable in a first direction (+Z) and a second direction (−Z) as a direction opposite to the first direction; and a second support member (66) that supports the second optical unit (30) to be movable in a third direction (+RZ) and a fourth direction (−RZ) as a direction opposite to the third direction, wherein the drive unit (60, 60*a*) includes:

a first mechanism (62, 63) that transforms rotary drive force generated by a drive source (61) into force for moving the first optical unit (20) in the first direction (+Z) and the second direction (−Z); and a second mechanism (62, 64, 65) that transforms the rotary drive force into force for moving the second optical unit (30) in the third direction (+RZ) and the fourth direction (−RZ).

Appendix 2

The illumination device (100, 300) according to appendix 1, wherein the first mechanism includes a feed screw mechanism (62, 63) that applies force in the first direction (+Z) and force in the second direction (−Z) to the first optical unit (20).

Appendix 3

The illumination device (100, 300) according to appendix 1 or 2, further comprising a toggle mechanism (70) that applies force for moving the first optical unit (20) in the first direction (+Z) when the first optical unit (20) moving in the first direction (+Z) crosses a predetermined first reference position and applies force for moving the first optical unit (20) in the second direction (−Z) when the first optical unit (20) moving in the second direction (−Z) crosses a predetermined second reference position.

Appendix 4

An illumination device (200) comprising:

a light source unit (10) that emits light (L1);

a first optical unit (20*a*) that lets the light (L1) enter and changes a divergence angle of the entered light (L1);

a second optical unit (30) including an image light formation region (31) that lets the light (L2) with the changed divergence angle enter and emits light (L31) including image light having image information;

a drive unit (60) that moves the first optical unit (20*a*) and the second optical unit (30);

a first support member (26) that supports the first optical unit (20*a*) to be movable in a first direction (+Z) and a second direction (−Z) as a direction opposite to the first direction;

a second support member (66) that supports the second optical unit (30) to be movable in a third direction (+RZ) and a fourth direction (−RZ) as a direction opposite to the third direction; and an elastic member (80) that applies force in the first direction (+Z) to the first optical unit (20*a*), wherein the drive unit (60) includes:

a first mechanism (62, 63) that transforms rotary drive force generated by a drive source (61) into force for moving the first optical unit (20*a*) in the second direction (−Z); and a second mechanism (62, 64-66) that transforms the rotary drive force into force for moving the second optical unit (30) in the third direction (+RZ) and the fourth direction (−RZ).

Appendix 5

The illumination device (200) according to appendix 4, wherein the first mechanism includes a feed screw mechanism (62, 63) that applies force in the second direction (−Z) to the first optical unit (20*a*).

Appendix 6

An illumination device comprising:

a light source unit (10) that emits light (L1);

a first optical unit (20, 20*a*) that lets the light (L1) enter and changes a divergence angle of the entered light (L1);

a second optical unit (30) including an image light formation region (31) that lets the light (L2) with the changed divergence angle enter and emits light (L31) including image light having image information;

a third optical unit (40, 43) that forms illuminating light having a predetermined light distribution pattern from the light (L3) emitted from the second optical unit (30) and emits the illuminating light; and a drive unit (60, 60*a*) that moves the first optical unit (20, 20*a*) and the second optical unit (30), wherein the third optical unit (43) includes:

a lens part (41) that lets the light (L3) emitted from the second optical unit (30) enter; and a reflector part (42) that is arranged outside the lens part (41) and reflects the light (L3) emitted from the second optical unit (30), and the lens part (41) includes:

a light condensation part that condenses the light (L3) emitted from the second optical unit (30); and a light transmissive support part that supports the light condensation part.

Appendix 7

The illumination device according to appendix 6, wherein the reflector part (42) is a concave mirror.

DESCRIPTION OF REFERENCE CHARACTERS

10: light source unit, 11: base member, 12: holding part, 20, 20*a*: first optical unit, 21, 22: first optical unit (light distribution variable lens), 21*a*, 21*b*, 21*c*, 21*d*, 21*e*: optical surface, 25, 26: support member, 30: second optical unit (image light formation unit), 31: image light formation region, 32: light transmissive region, 40: third optical unit (projection lens), 40*a*, 40*b*, 40*c*, 40*d*, 40*e*: optical surface, 41: lens part, 41*a*, 41*b*, 41*c*: optical surface, 41*d*: support part. 42: reflector part. 43: third optical unit, 60, 60*a*: drive unit, 61: motor, 62: feed screw, 63: slide nut, 64, 65, 66: gear, 67, 68: bevel gear, 80: elastic member, 100, 200, 300: illumination device.

What is claimed is:

1. An illumination device comprising:

a light source unit to emit light;

a first optical unit to let the light enter and to change a divergence angle of the entered light;

a second optical unit including an image light formation region, the second optical unit letting the light with the changed divergence angle enter and emitting light including image light configured to form an image on an illuminated surface; and a drive unit configured to move the first optical unit and the second optical unit, and the drive unit is further configured to execute a first operation of translating that translates the first optical unit in a direction of an optical axis of the first optical unit.

2. The illumination device according to claim 1, wherein the drive unit executes a second operation of rotating the second optical unit without moving the first optical unit.

3. The illumination device according to claim 2, wherein the illumination device is capable of switching between a projection function of projecting light including image light onto a predetermined illuminated surface and an illumination function of emitting light not including image light towards the illuminated surface, the drive unit switches between the projection function and the illumination function by executing the first operation, and the drive unit changes a direction of the image projected on the illuminated surface at a time of the projection function by executing the second operation.

4. The illumination device according to claim 2, further comprising:

a first support member to support the first optical unit to be movable in a first direction and a second direction as a direction opposite to the first direction; and a second support member to support the second optical unit to be movable in a third direction and a fourth direction as a direction opposite to the third direction.

5. The illumination device according to claim 4, wherein the first direction is a direction for increasing distance from the light source unit to the first optical unit, the second direction is a direction for decreasing the distance from the light source unit to the first optical unit, the third direction is a direction for rotating the second optical unit in a predetermined direction without changing distance from the light source unit to the second optical unit, and the fourth direction is a direction for rotating the second optical unit in a direction opposite to the predetermined direction without changing the distance from the light source unit to the second optical unit.

6. The illumination device according to claim 4, wherein the first direction and the second direction are directions parallel to an optical axis of the first optical unit, and the third direction and the fourth direction are rotation directions around an axis parallel to an optical axis of the second optical unit as a rotation axis.

7. The illumination device according to claim 4, wherein the second support member is a gear that applies force for moving in the third direction and the fourth direction to the second optical unit while supporting the second optical unit.

8. The illumination device according to claim 4, wherein the drive unit includes a drive mechanism that transforms rotary drive force generated by a drive source into force for translating the first optical unit and transmits the force to the first support member while also transforming the rotary drive force into force for rotating the second optical unit and transmitting the force to the second support member.

9. The illumination device according to claim 8, wherein the drive mechanism includes a feed screw mechanism, and translational force in regard to at least one of the first direction and the second direction is transmitted to the first support member by the feed screw mechanism.

10. The illumination device according to claim 8, wherein the drive mechanism includes a gear, and turning force in regard to at least one of the third direction and the fourth direction is transmitted to the second support member by the gear.

11. The illumination device according to claim 10, wherein the gear includes a bevel gear.

12. The illumination device according to claim 8, wherein the drive source is one motor.

13. The illumination device according to claim 4, further comprising a toggle mechanism to apply force for moving the first optical unit in the first direction when the first optical unit moving in the first direction crosses a predetermined first reference position and to apply force for moving the first optical unit in the second direction when the first optical unit moving in the second direction crosses a predetermined second reference position.

14. The illumination device according to claim 4, further comprising an elastic member to apply translational force in the first direction or the second direction to the first optical unit.

15. The illumination device according to claim 2, wherein the image light formation region forms the image, selected from among a plurality of types of images, on the illuminated surface.

16. The illumination device according to claim 2, wherein the image light formation region is formed of a light blocking member including a plurality of light transmitting regions each capable of forming a different image.

17. The illumination device according to claim 2, wherein the image light formation region is formed of an optical member that is configured to form an image on the illuminated surface based on an image signal.

18. The illumination device according to claim 1, wherein the illumination device is capable of switching between a projection function of projecting light including image light onto a predetermined illuminated surface and an illumination function of emitting light not including image light towards the illuminated surface, and the drive unit switches between the projection function and the illumination function by executing the first operation.

19. An illumination device comprising:

a light source unit that emits light;

a first optical unit that lets the light enter and changes a divergence angle of the entered light;

a second optical unit including an image light formation region, the second optical unit letting the light with the changed divergence angle enter and emitting light including image light configured to form an image on an illuminated surface; and a drive unit configured to move the first optical unit and the second optical unit, wherein the drive unit is further configured to execute a first operation of translating that translates the first optical unit in a predetermined direction and a second operation of rotating the second optical unit without moving the first optical unit.

* * * * *